US011234880B2

(12) United States Patent
Ballantyne et al.

(10) Patent No.: US 11,234,880 B2
(45) Date of Patent: Feb. 1, 2022

(54) ISOLATION TENT

(71) Applicant: Care Strategic D.I.R. Holdings Pty. Ltd., Ninderry (AU)

(72) Inventors: Anna Louise Ballantyne, Ninderry (AU); Justin Douglas Ballantyne, Ninderry (AU); James Edward Robert Burkwood, Buderim (AU)

(73) Assignee: Care Strategic D.I.R. Holdings Pty. Ltd.

( * ) Notice: Subject to any disclaimer, the term of this patent is extended or adjusted under 35 U.S.C. 154(b) by 63 days.

(21) Appl. No.: 16/492,909

(22) PCT Filed: Mar. 15, 2018

(86) PCT No.: PCT/AU2018/050239
§ 371 (c)(1),
(2) Date: Sep. 10, 2019

(87) PCT Pub. No.: WO2018/165715
PCT Pub. Date: Sep. 20, 2018

(65) Prior Publication Data

US 2020/0069495 A1 Mar. 5, 2020

(30) Foreign Application Priority Data

Mar. 16, 2017 (AU) ..... 2017900925

(51) Int. Cl.
*A61G 10/00* (2006.01)
*E04H 1/12* (2006.01)

(52) U.S. Cl.
CPC ..... *A61G 10/005* (2013.01); *E04H 1/1277* (2013.01)

(58) Field of Classification Search
CPC ..... A61G 10/00; A61G 10/005; A61G 10/02; A61G 10/04; E04H 1/1277
See application file for complete search history.

(56) References Cited

U.S. PATENT DOCUMENTS 3,028,871 A 4/1962 Clift, Jr.
3,526,066 A 9/1970 Hager et al.
(Continued)

FOREIGN PATENT DOCUMENTS

CA 1276856 11/1990
CA 2556140 2/2008
(Continued)

OTHER PUBLICATIONS

Horton Automatics, "Negative, Positive & Combination Pressure Room Door Systems: Isolation Room Door Systems for Airborne Infection Control," 2011, 2 Pages, Form No. A525, Horton Automatics, United States of America.
(Continued)

*Primary Examiner* — John P Lacyk
(74) *Attorney, Agent, or Firm* — George C. Rondeau, Jr.; Davis Wright Tremaine LLP

(57) ABSTRACT

Apparatus for use in providing isolation, the apparatus including an isolation tent having a body including a roof member, at least one wall extending between a supporting surface and the roof member in use to thereby at least partially define an internal volume substantially isolated from a surrounding environment, a plurality of connectors coupled to the body, the plurality of connectors being adapted to physically attach the body to a frame and an electrical component electrically connected to at least one of the plurality of connectors to allow electrical signals to be transferred to or from the electrical component via the connector.

20 Claims, 28 Drawing Sheets

(56) References Cited

U.S. PATENT DOCUMENTS

| | | | |
|---|---|---|---|
| 3,563,257 | A | 2/1971 | Cummins |
| 3,875,953 | A | 4/1975 | Couix |
| 3,923,134 | A | 12/1975 | Rezazadeh |
| 4,067,347 | A | 1/1978 | Lipinski |
| 4,310,195 | A | 1/1982 | Huff |
| 4,505,078 | A | 3/1985 | Huh |
| 4,707,953 | A | 11/1987 | Anderson et al. |
| 4,844,109 | A | 7/1989 | Navarro |
| 4,934,396 | A | 6/1990 | Vitta |
| 5,368,057 | A | 11/1994 | Lubkeman et al. |
| 5,619,821 | A | 4/1997 | St. George et al. |
| 5,706,846 | A | 1/1998 | Sutton |
| 6,035,875 | A | 3/2000 | Chen |
| 6,112,757 | A | 9/2000 | Tseng |
| 6,148,835 | A | 11/2000 | Rhee |
| 6,390,110 | B1 | 5/2002 | Brown |
| 6,454,340 | B1 | 9/2002 | Miller et al. |
| 7,021,694 | B1 | 4/2006 | Roberts et al. |
| 7,134,444 | B2 | 11/2006 | Mintie et al. |
| 7,406,978 | B2 | 8/2008 | Mintie et al. |
| 7,584,763 | B2 | 9/2009 | Yoon |
| 7,789,099 | B2 | 9/2010 | Mallookis et al. |
| 8,043,562 | B2 | 10/2011 | Tomasso et al. |
| 8,082,938 | B2 | 12/2011 | Prusmack et al. |
| 8,429,858 | B1 | 4/2013 | Robinson et al. |
| 8,622,066 | B2 | 1/2014 | Dolsby et al. |
| 8,882,135 | B1 | 11/2014 | Chen |
| 9,373,943 | B1 | 6/2016 | Tannenbaum |
| 9,534,407 | B2 | 1/2017 | Ballantyne et al. |
| 2002/0074032 | A1 | 6/2002 | Park et al. |
| 2002/0184631 | A1 | 12/2002 | Cezeaux et al. |
| 2003/0037812 | A1 | 2/2003 | Stewart et al. |
| 2003/0074845 | A1 | 4/2003 | Sample et al. |
| 2004/0020526 | A1 | 2/2004 | Deng |
| 2004/0050008 | A1 | 3/2004 | Mintie et al. |
| 2004/0050412 | A1 | 3/2004 | Dotterweich |
| 2004/0071587 | A1 | 4/2004 | McAtarian |
| 2004/0074212 | A1 | 4/2004 | Yachi et al. |
| 2004/0084074 | A1 | 5/2004 | Chiu et al. |
| 2004/0144412 | A1 | 7/2004 | Tsai |
| 2004/0144413 | A1 | 7/2004 | Matthews et al. |
| 2004/0173252 | A1 | 9/2004 | Bouchard |
| 2004/0261828 | A1 | 12/2004 | Jang |
| 2005/0011006 | A1 | 1/2005 | Ellen et al. |
| 2005/0194032 | A1 | 9/2005 | Zeigler |
| 2006/0020159 | A1 | 1/2006 | Ellen |
| 2006/0248809 | A1 | 11/2006 | Rulquin et al. |
| 2007/0051397 | A1 | 3/2007 | Choi |
| 2008/0006318 | A1 | 1/2008 | Tseng |
| 2008/0060691 | A1 | 3/2008 | Harker |
| 2008/0184631 | A1 | 8/2008 | Schofield |
| 2008/0257394 | A1 | 10/2008 | Tseng |
| 2009/0301537 | A1 | 12/2009 | Finck et al. |
| 2010/0006131 | A1 | 1/2010 | Liu |
| 2010/0044369 | A1 | 2/2010 | Toepfer et al. |
| 2012/0006369 | A1 | 1/2012 | Cantin et al. |
| 2012/0090660 | A1 | 4/2012 | Keller et al. |
| 2012/0266544 | A1 | 10/2012 | Lazarovits |
| 2012/0325279 | A1 | 12/2012 | Munoz |
| 2013/0298477 | A1 | 11/2013 | Krummenacher |
| 2014/0235153 | A1 | 8/2014 | Rankin |
| 2014/0283889 | A1 | 9/2014 | Zhou |
| 2015/0075085 | A1 | 3/2015 | Newkirk et al. |
| 2016/0074268 | A1 | 3/2016 | Breegi et al. |

FOREIGN PATENT DOCUMENTS

| | | | |
|---|---|---|---|
| CN | 1491629 | A | 4/2004 |
| CN | 201924648 | | 8/2011 |
| CN | 202568704 | | 12/2012 |
| CN | 104684528 | A | 6/2015 |
| CN | 204492322 | | 7/2015 |
| CN | 106013946 | A | 10/2016 |
| EP | 0619108 | | 10/1994 |
| KR | 200359088 | Y1 | 8/2004 |
| WO | 2004011163 | | 2/2004 |
| WO | 2006017684 | | 2/2006 |
| WO | 2006110797 | A2 | 10/2006 |
| WO | 2008055453 | | 5/2008 |
| WO | 2014019022 | | 2/2014 |
| WO | 2014201334 | A1 | 12/2014 |
| WO | 2016046507 | A1 | 3/2016 |

OTHER PUBLICATIONS

Solovyova, "Tents for Tourism," BHW St. Petersburg, 2005, 29 pages.

Fig. 12A
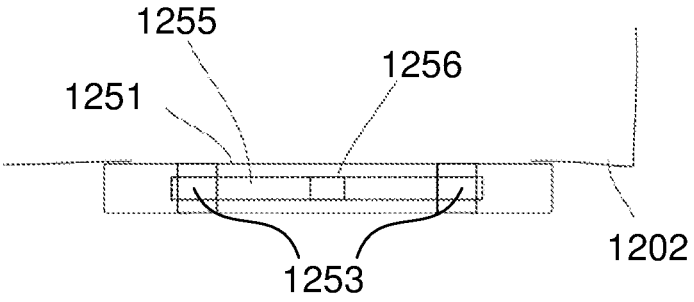
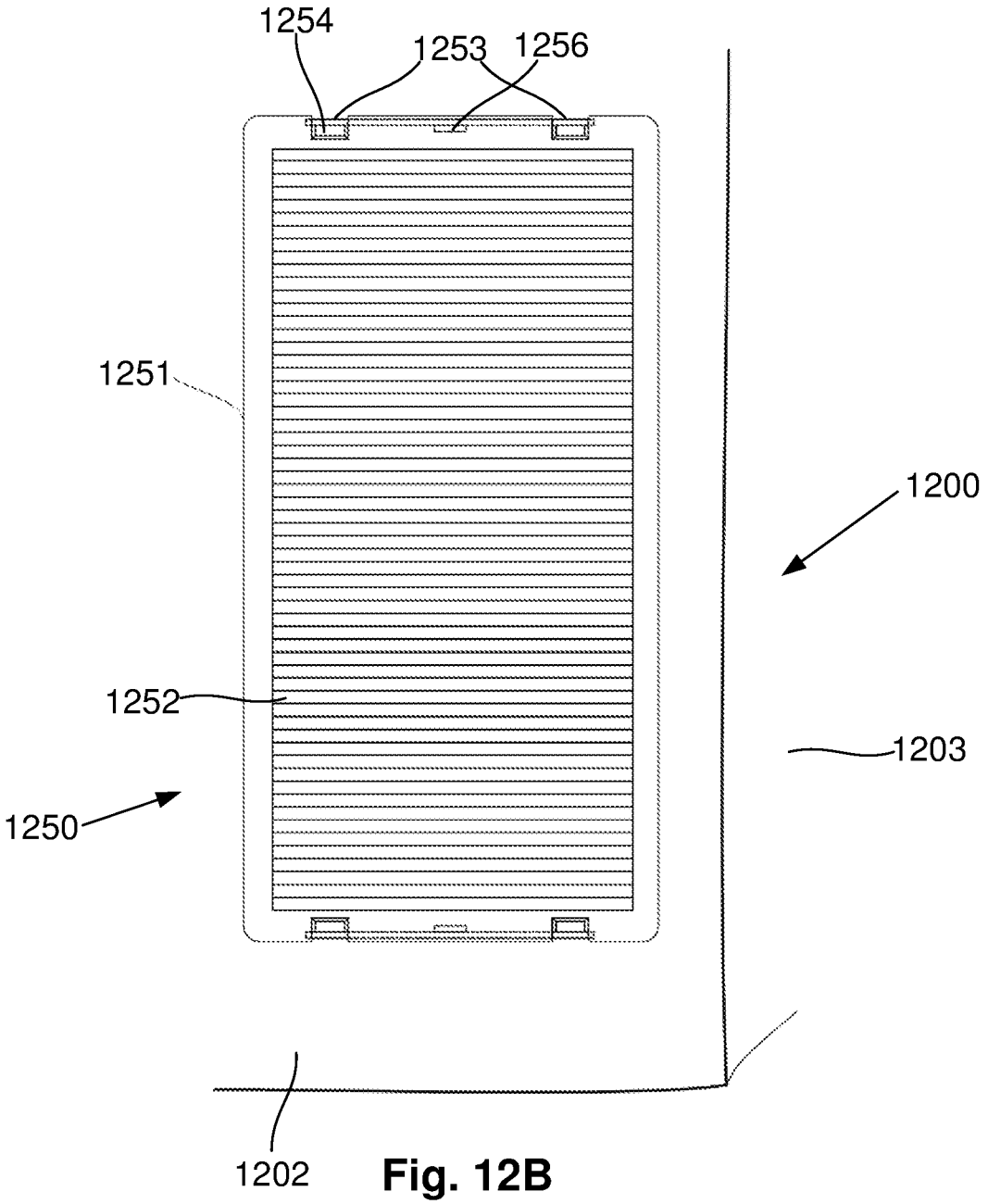
Fig. 12B

Fig. 12D
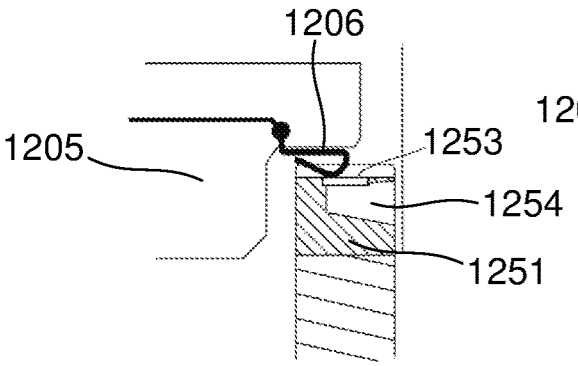
Fig. 12F
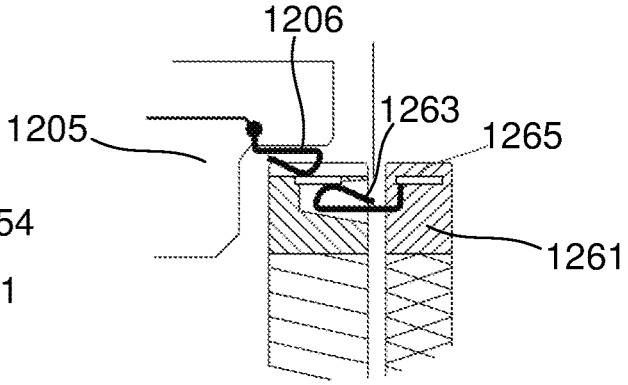
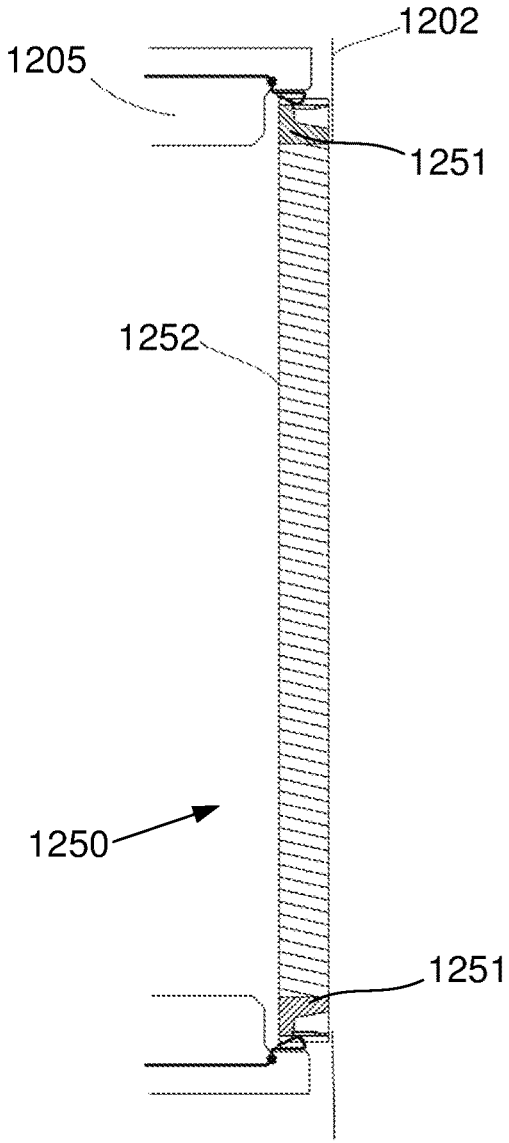
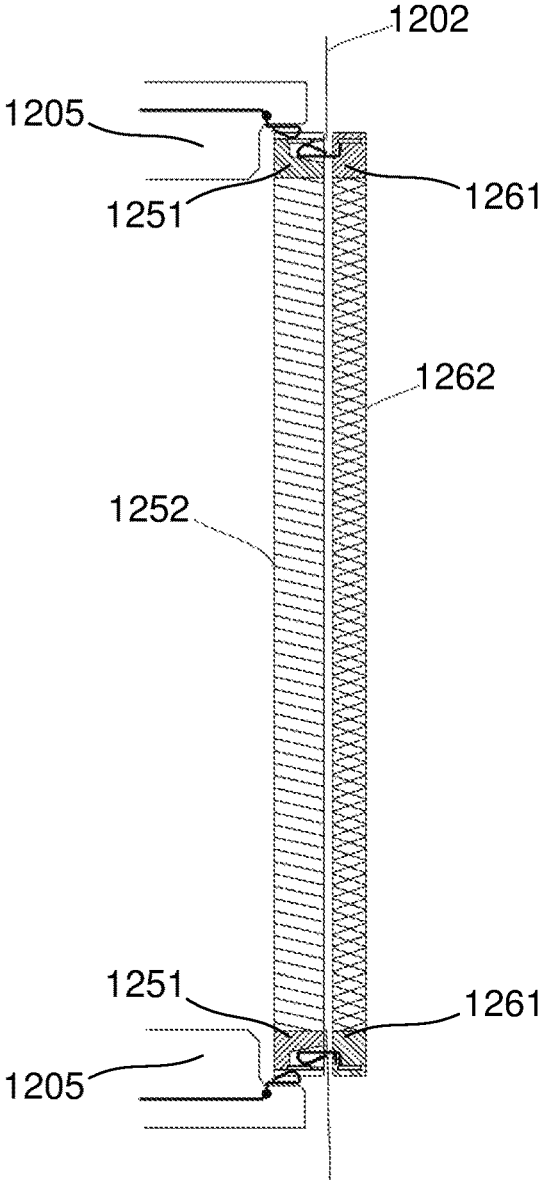
Fig. 12C
Fig. 12E

ISOLATION TENT

BACKGROUND OF THE INVENTION

The present invention relates to an isolation tent for use in providing isolation, and in one example, to an isolation tent for isolating a subject, such as a patient or equipment within a healthcare facility, such as a hospital ward, or the like.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Infection control in hospitals and other healthcare facilities is becoming increasingly important with the rise in incidences of infectious diseases, drug resistant infections, or the like. Such infections can have severe consequences, particularly in patients with an already compromised immune system, resulting in increased duration of hospital stays, increased treatment costs and increased mortality. Estimates indicate that in some healthcare institutions infection levels can be in the region of 10-20%, meaning infections acquired in medical facilities represent a significant proportion of annual healthcare expenditure.

Infections are typically transmitted through a number of different mechanisms, including contact transmission, droplet transmission and airborne transmission. Current best practice for reducing infection rates typically relies on basic hygiene measures, such as regular hand washing, surface sanitisation, and equipment sterilisation, to thereby prevent infection of other patients. However, the effectiveness of such measures is limited, and World Health Organisation standards indicate that patients with infections or suspected of having infections should be isolated from other patients. This can prove difficult with many facilities not having adequate resources and available space to separate infected patients.

A number of solutions have been proposed to such issues.

EP-0,619,108 describes an enclosure for isolating a patient including an external frame and a flexible envelope suspended from and hanging within the frame. The envelope has a bottom, top, two sides, front and a rear wall portions. One of the side or front wall portions is fitted with a closable entry means allowing entry of the patient. There is an opening in one of the wall portions fitted with an integral filter means adapted to filter out infectious particles from the air and to cooperate with a pump means, and a valve means allowing uni-directional air passage from the outside to the inside of the enclosure. The pump means draws air through said filter means which creates a negative pressure inside the enclosure, whereby air flows in the direction valve-enclosure-filter means ensuring that no contaminating agents will escape from within the enclosure to the outside.

US2004074212 describes a patient isolation unit including a foldable frame body, a flexible envelope made of a flammable resin sheet which can be attached to the assembled frame body, and an exhauster to discharge or exhaust the air from the envelope. The exhauster includes a UV lamp, an HEPA (High-Efficiency Particulate Air) filter, and a blower.

However, these arrangements suffer from a number of drawbacks. For example, the need to maintain a hermetically sealed envelope makes the apparatus complex and hence expensive. The arrangements are also difficult to erect as well as requiring that the arrangement is erected with the patient being subsequently moved into the envelope, which can be inconvenient and which may prevent the arrangements being used in some circumstances. Finally, these arrangements typically require that the doors are opened manually, by hand, meaning infectious materials can be transferred onto the door when this is being opened, leading to subsequent onward transmission, and thereby limiting the effectiveness of the arrangements.

WO2014/019022 describes an apparatus for use in isolating a subject, the apparatus including a frame movable between collapsed and erected configurations, a body supported by the frame, wherein in the erected configuration, the body defines an internal volume for containing a subject to thereby substantially isolate the subject from a surrounding environment and a door actuator supported by the frame for moving a door between open and closed positions to thereby provide access to the internal volume.

SUMMARY OF THE PRESENT INVENTION

In one broad form an aspect of the present invention seeks to provide an apparatus for use in providing isolation, the apparatus including an isolation tent having a body including: a roof member; at least one wall extending between a supporting surface and the roof member in use to thereby at least partially define an internal volume substantially isolated from a surrounding environment; a plurality of connectors coupled to the body, the plurality of connectors being adapted to engage a frame; and, an electrical component electrically connected to at least one of the plurality of connectors to allow electrical signals to be transferred to or from the electrical component via the connector.

In one embodiment the connectors are adapted to at least one of physically attach the body to the frame and physically couple to frame connectors of the frame.

In one embodiment the connector includes a pin and the frame connector includes a socket, wherein the pin is inserted into the socket to couple the frame connector to the frame.

In one embodiment the socket includes a catch to secure the pin and a release mechanism to selectively release the pin.

In one embodiment the connectors and frame connectors are mechanically coupled using at least one of: a complementary plug and socket connection; a friction fit; a hook and eye; an interference fit; and, a clip fit.

In one embodiment the frame connector includes a channel in the frame, and the connector includes a slotted peg slidably mounted within the channel.

In one embodiment the frame includes multiple channels and each channel includes an opening shaped to receive a respective slotted peg, thereby allowing pegs to be slidably mounted within respective channels.

In one embodiment the channel includes a releasable lock used to selectively lock the peg within the channel.

In one embodiment the electrical component is at least one conductor extending at least part way across the body, the conductor being electrically connected to at least one of the plurality of connectors to allow electrical signals to be conducted via the at least one connector and the at least one conductor.

In one embodiment the at least one conductor is adapted to conduct at least one of: data communications signals; and, electrical power supply signals.

In one embodiment the connectors are adapted to electrically couple to frame connectors mounted to the frame, and wherein the frame connectors are electrically connected to respective electrical components.

In one embodiment at least one frame connector is electrically connected to an electrical power supply and at least one frame connector is electrically connected to electrical equipment mounted to the frame so that the electrical equipment can be powered by the electrical power supply via the at least one conductor.

In one embodiment the at least one conductor includes at least one of: wires embedded in or attached to the body; silver plated nylon conductors provided on a surface of the body; conductive material printed on, sewn to, embedded within or adhered to the body; and, silver plated nanowire conductors provided on a surface of the body.

In one embodiment the at least one conductor extends at least partially along a seam between the wall and the roof.

In one embodiment the electrical component includes lighting for illuminating the internal volume.

In one embodiment the electrical component is used to verify the body.

In one embodiment the electrical component includes a memory that stores verification data, and wherein the verification data is retrieved by a processing device when the body is connected to the frame, allowing the processing device to verify the body.

In one embodiment the memory is writable allowing the verification data to be updated during use.

In one embodiment the verification data is used to verify the body to confirm at least one of: the body is a correct body for use with a current frame; the body has not exceeded an expiry date; the body has not exceeded a shelf life; the body has not exceeded a defined duration of use; and, the body has not been previously used.

In one embodiment the verification data includes at least one of: a digital signature; a unique reference number; and, encrypted data.

In one embodiment the body includes a filter member that filters air flowing into or out of the internal volume.

In one embodiment the filter member is mounted in at least one of a side wall and the roof.

In one embodiment the filter member forms part of an air filtration system in use.

In one embodiment the filter member includes a connector that is adapted to physically attach the filter member to the frame.

In one embodiment the filter member includes a filter frame supporting a filter body, and wherein the connector is formed by the filter frame which engages a filter mounting on the frame to thereby attach the filter member to the frame.

In one embodiment the filter member includes first and second filter member contacts mounted on the filter frame and electrically connected to the electrical component.

In one embodiment the first and second filter member contacts engage frame contacts attached to the filter mounting, and wherein the frame contacts are electrically connected to electrical equipment to thereby electrically connect the electrical component to the electrical equipment.

In one embodiment the electrical component includes a conductor extending between the first and second filter member contacts.

In one embodiment the filter member contacts are mounted in respective recesses in the filter frame.

In one embodiment the electrical component is configured to conduct power for at least one of: an air filtration system; and, a door actuator.

In one embodiment the body includes adhesive extending at least part way round the filter member to thereby attach the body to the air filtration system.

In one embodiment the body is adapted to sealingly engage the air filtration system.

In one embodiment the filter member is at least one of: a charcoal filter; a carbon filter; a particulate filter; and, a HEPA filter.

In one embodiment the body includes curtains defining a door.

In one embodiment the curtains are attached to the body in an open position, and are detachable to allow the curtains to be attached to a door mechanism mounted to the frame.

In one embodiment the body includes four wall members mounted to a rectangular roof member.

In one embodiment the roof member comprises a flexible air permeable sheet material and the wall members comprise flexible water resistant sheet material.

In one embodiment the body is removably mounted inwardly of the frame in use.

In one embodiment the walls engage a surface supporting the apparatus using an at least partially adhesive material provided on a lower edge of the walls.

In one embodiment the body is disposable.

In one embodiment the body is supplied in a packaging having an opening, and wherein the body is folded within the packaging so that the plurality of connectors are accessible without at least one of: unfolding the body; and, removing the body from the packaging.

In one embodiment, in use, the body can be attached to a frame in a collapsed position by attaching the connectors to the frame with the packaging being subsequently removed, although this is not essential and alternatively the packaging could be removed prior to attaching the body to the frame.

In one embodiment the packaging remains attached to the body and is adapted to act as a refuse receptacle.

In one broad form an aspect of the present invention seeks to provide an apparatus for use in providing isolation, the apparatus including a body having: a roof member; at least one wall extending between a supporting surface and the roof member in use to thereby at least partially define an internal volume substantially isolated from a surrounding environment; and, machine readable verification data, wherein the verification data is read by a processing device when the body is connected to the frame, allowing the processing device to verify the body.

In one embodiment the machine readable verification data is at least one of: presented as visual markings provided on the isolation tent; and, stored in a memory attached to the isolation tent and read via at least one of: wired connections via a connector; wired connections via a coupling between a filter unit and either the isolation tent or a filter member; and, wireless connections.

In one broad form an aspect of the present invention seeks to provide a method for use in providing isolation using an apparatus including a body having: a roof member; and, at least one wall extending between a supporting surface and the roof member in use to thereby at least partially define an internal volume substantially isolated from a surrounding environment, the method including in one or more electronic processing devices: reading machine readable verification data when the body is connected to a frame; verifying the body using the verification data; and, selectively activating one or more electronic components in response to successful verification of the body.

In one embodiment the one or more electronic processing devices: read machine readable verification data when the body is connected to a frame; verify the body using the verification data; and, selectively activate one or more electronic components in response to successful verification of the body.

In one broad form an aspect of the present invention seeks to provide an apparatus for use in providing isolation, the apparatus including a body having: a roof member; at least one wall extending between a supporting surface and the roof member in use to thereby at least partially define an internal volume substantially isolated from a surrounding environment; and, a filter member that filters air flowing into or out of the internal volume.

In one embodiment the filter member includes a connector that is adapted to physically attach the filter member to the frame.

In one embodiment the filter member includes a filter frame supporting a filter body, and wherein the connector is formed by the filter frame which engages a filter mounting on the frame to thereby attach the filter member to the frame.

In one embodiment the apparatus includes an electrical component electrically connected to the connector to allow electrical signals to be transferred to or from the electrical component via the connector.

In one embodiment the filter member includes first and second filter member contacts mounted on the filter frame and electrically connected to the electrical component.

In one embodiment the first and second filter member contacts engage frame contacts attached to the filter mounting, and wherein the frame contacts are electrically connected to electrical equipment to thereby electrically connect the electrical component to the electrical equipment.

In one embodiment the filter member contacts are mounted in respective recesses in the filter frame.

In one embodiment the electrical component includes a conductor extending between the first and second filter member contacts.

In one embodiment the electrical component is configured to conduct power for at least one of: an air filtration system; and, a door actuator.

In one embodiment the filter member forms part of an air filtration system in use.

In one broad form an aspect of the present invention seeks to provide an apparatus for use in providing isolation, the apparatus including a body having: a roof member; at least one wall extending between a supporting surface and the roof member in use to thereby at least partially define an internal volume substantially isolated from a surrounding environment; and, curtains defining a door, wherein the curtains are attached to the body in an open position, and are detachable to allow the curtains to be attached to a door mechanism mounted to the frame.

In one broad form an aspect of the present invention seeks to provide an apparatus for use in providing isolation, the apparatus including a body having: a roof member; at least one wall extending between a supporting surface and the roof member in use to thereby at least partially define an internal volume substantially isolated from a surrounding environment; a plurality of connectors coupled to the body, the plurality of connectors being adapted to engage a frame; and, at least one conductor extending at least part way across the body, the conductor being electrically connected to at least two of the plurality of connectors to allow electrical signals to be conducted via the two connectors and the at least one conductor.

In one embodiment the apparatus includes a frame movable between collapsed and erected configurations, the frame including: a number of upright legs; and, a number of lateral connecting members interconnecting the legs, the connecting members including scissor arms movable between retracted and extended positions and wherein scissor arms on adjacent sides of the frame are independent so that the frame can be extended in a first direction and then subsequently in a second direction orthogonal to the first direction.

In one embodiment the apparatus includes a processing device that reads machine readable verification data provided on the body when the body is connected to the frame, allowing the processing device to verify the body.

In one embodiment the processing device is provided within a filter unit mounted to the frame.

In one embodiment the processing device reads the machine readable verification data by at least one of: optically sensing visual markings provided on the isolation tent; retrieving verification data from a memory attached to the isolation tent via at least one of: wired connections via a connector; wired connections via a coupling between a filter unit and either the isolation tent or a filter member; and, wireless connections.

In one embodiment the processing device controls one or more functional components, and wherein the processing device selectively activates the functional components in response to verification of the body.

In one embodiment the functional components include at least one of: a door actuator that opens doors; and, an air filtration system.

In one broad form an aspect of the present invention seeks to provide a method of packing a body within packaging, the body including a roof member; at least one wall member attached to the roof member, so that the at least one wall member can extend between a supporting surface and the roof member in use to thereby at least partially define an internal volume substantially isolated from a surrounding environment; a plurality of connectors coupled to the body, the plurality of connectors being adapted to engage a frame, and being provided proximate corners of the roof member, the method including: folding first opposing sides along an upright mid line so that second opposing sides are brought into proximity; and, in either order: concertinaing the second opposing wall members; and, folding the body lengthwise.

In one embodiment the method includes concertinaing the second opposing sides using an odd number of folds.

In one embodiment the method includes: folding opposing front and back walls to bring side walls together; and, concertinaing the side walls.

In one embodiment the method includes: folding opposing front and back sides to bring front corners together and back corners together; concertinaing the side walls; and, folding over a front left corner and back left corner to bring left corners together and right corners together.

In one broad form an aspect of the present invention seeks to provide a method of attaching a body to a frame, the method including accessing from a packaging containing the body, a plurality of connectors, the connectors being accessible without at least one of: unfolding the body; and, removing the body from the packaging; attaching the connectors to a frame in a collapsed position; and, extending the frame so that the body unfolds as the frame is extended.

It will be appreciated that the broad forms of the invention and their respective features can be used in conjunction, interchangeably and/or independently, and reference to separate broad forms is not intended to be limiting.

BRIEF DESCRIPTION OF THE DRAWINGS

Various examples and embodiments of the present invention will now be described with reference to the accompanying drawings, in which:

FIG. 12A is a schematic plan view of an example of a filter member;

FIG. 12B is a schematic front view of the filter member of FIG. 12A;

FIG. 12C is a schematic side view of the filter member of FIG. 12A;

FIG. 12D is a schematic side close-up view of the connector of the filter member of FIG. 12A;

FIG. 12E is a schematic side view of the filter member of FIG. 12A with an additional secondary filter member;

FIG. 12F is a schematic side close-up view of the connector of the filter member and secondary filter member of FIG. 12E;

DETAILED DESCRIPTION OF THE PREFERRED EMBODIMENTS

Figure 1A:
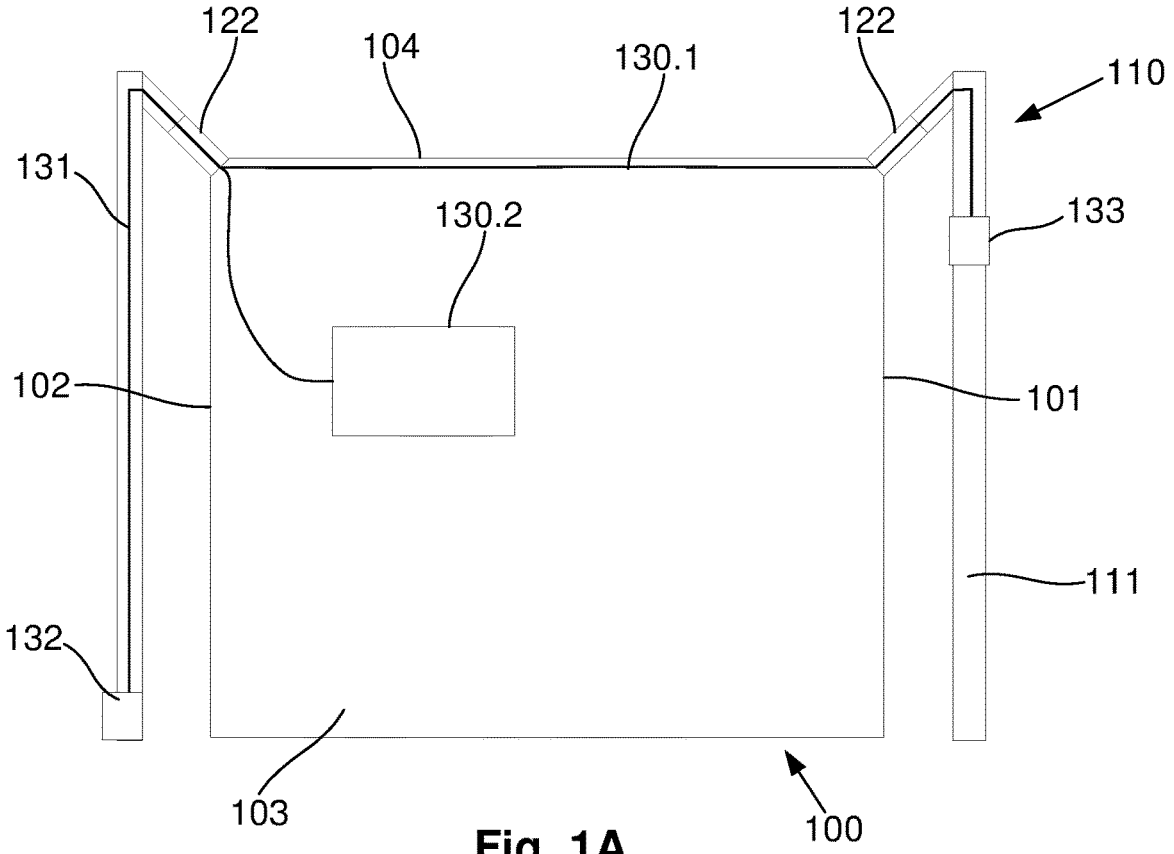
FIG. 1A is a schematic side view of an example of an isolation apparatus including an isolation tent.

An example of an isolation apparatus used for isolating a volume, for example to isolate a subject, such as a patient and/or contaminated items, will now be described with reference to FIGS. 6A to 6C, 7A to 7E, 8A to 8C and 9A to 9E.

It will be appreciated from the following description that the apparatus incorporates an isolation tent, and further features of the isolation tent will be described in more detail below once the context of operation of the isolation tent is understood from the following examples, which are based on the disclosure in WO2014/019022, the content of which is incorporated herein by reference.

In this example, the apparatus 600 includes a frame 610, which in use is movable between collapsed and erected configurations. An isolation tent having a body 620 is supported by the frame 610, so that when the frame 610 is in the erected configuration, the body 620 defines an internal volume 630 which can be substantially isolated from a surrounding environment. The internal volume can contain a subject, such as a patient on a bed 631, or other equipment, including equipment being sterilised, or the like, thereby isolating this from the surrounding environment. This can be used to prevent spread of infection from an isolated patient, or can be used to prevent exposure of people in the environment to UV radiation or the like in the event the apparatus is being used to sterilise equipment or the like.

Figure 6A:
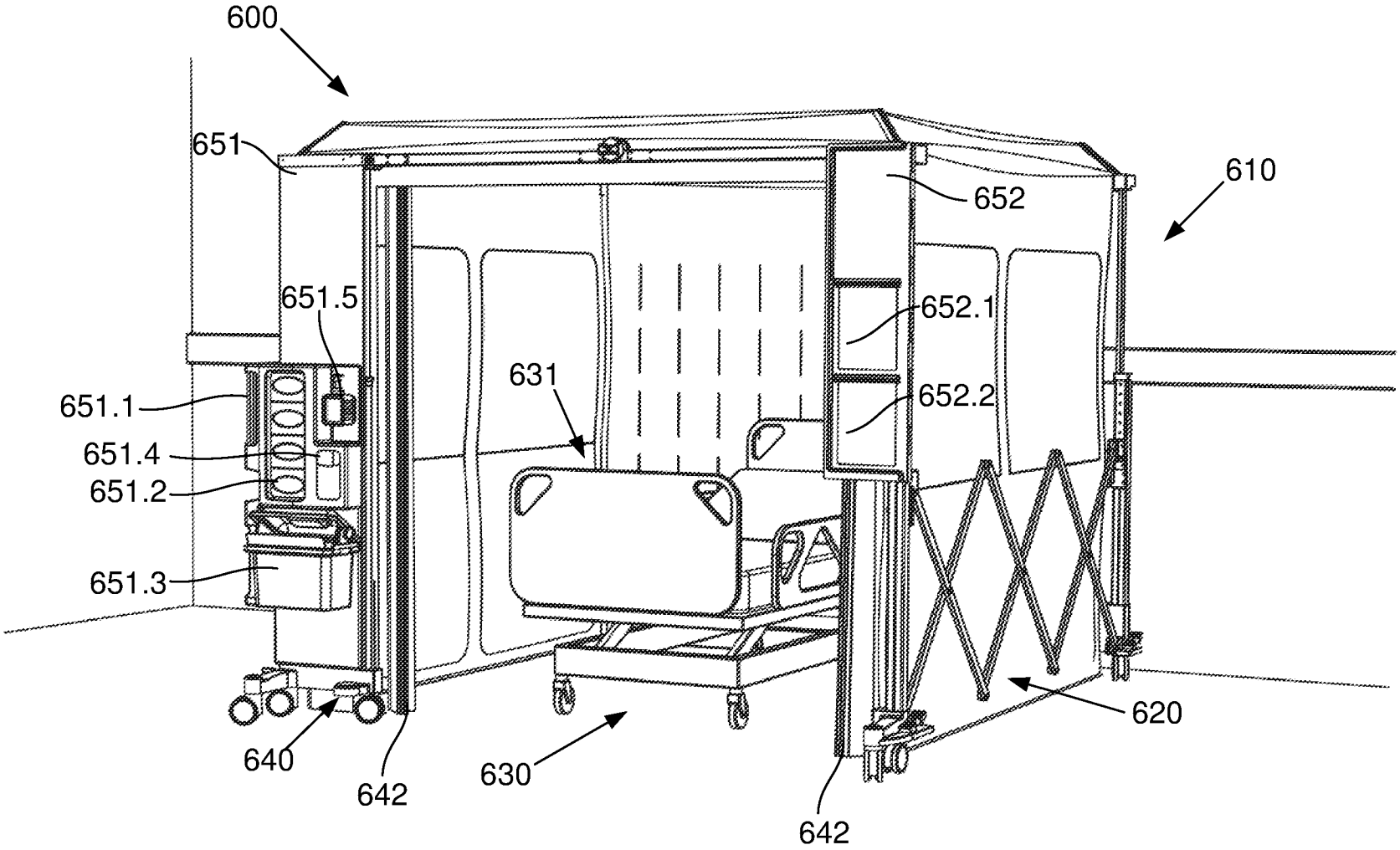
FIG. 6A is a schematic perspective view of an example of an apparatus for use in providing isolation.
Figure 6B:
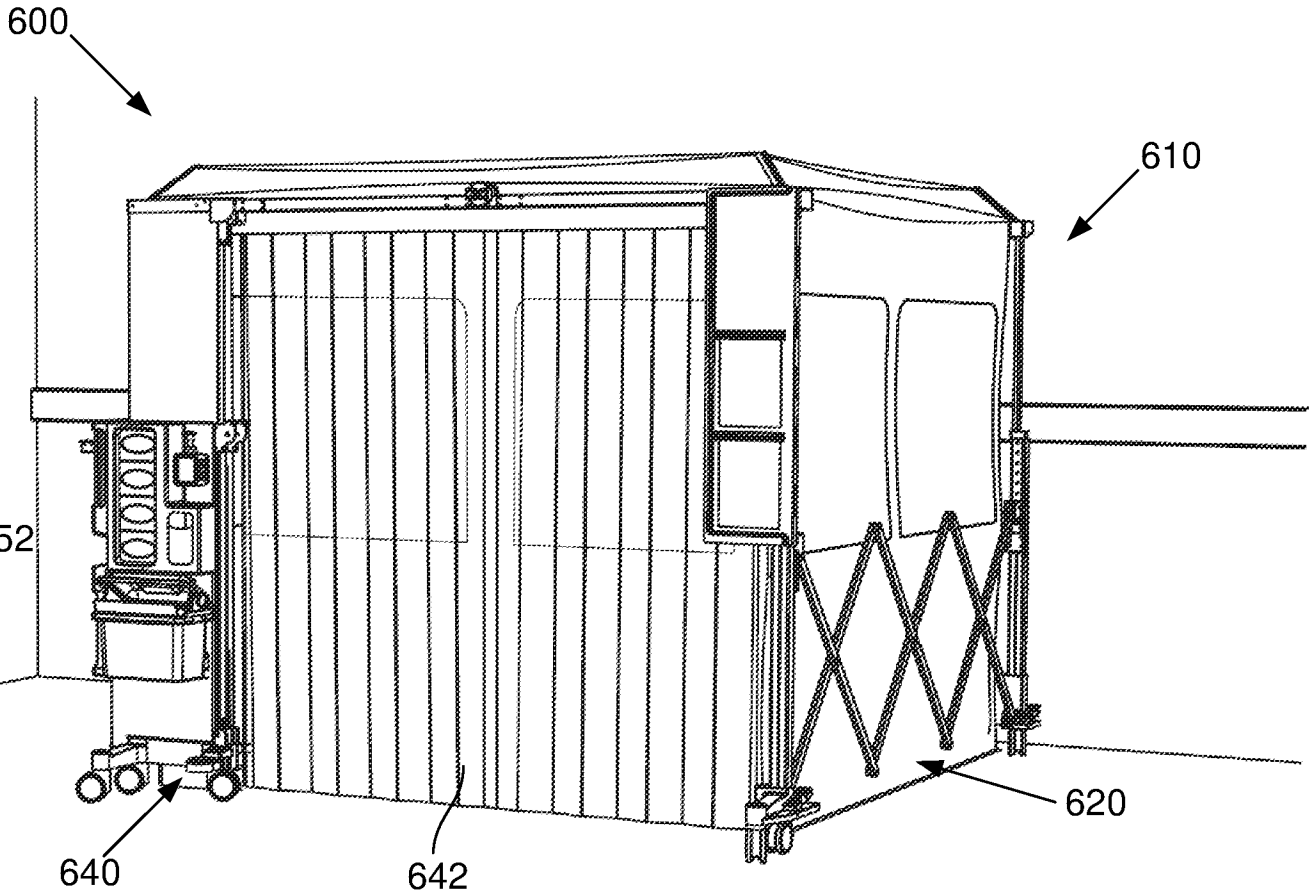
FIG. 6B is a schematic perspective view of the apparatus of FIG. 6A with a door in a closed position.
Figure 6C:
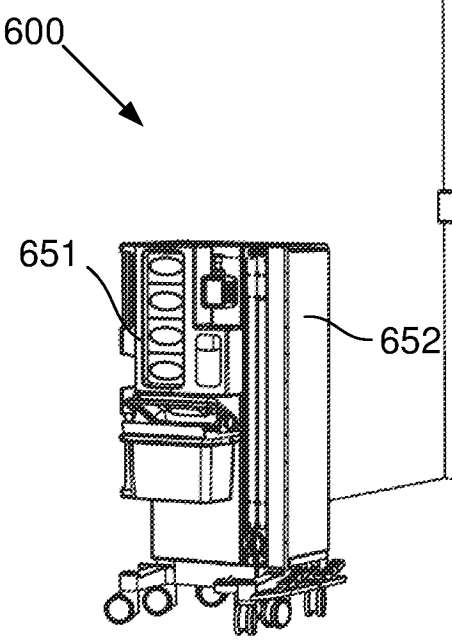
FIG. 6C is a schematic perspective view of the apparatus of FIG. 6A in a storage configuration.

The apparatus 600 can also include a door actuator 640 supported by, and in particular mounted either to, or within, the frame 610. The door actuator 640 is for moving a door 642 between open and closed positions, as shown in FIGS. 6A and 6B, respectively. In the closed position, the door closes the internal volume, whilst in the open position the door provides access to the internal volume, thereby allowing users, such as medical practitioners to access the subject when required, while isolating the subject at other times. In this example, the door actuator is in the form of a button connected to an electronic control system that controls opening and closing of the door, for example, using an electrical motor or the like, thereby facilitating hands-free access to the internal volume 630. It will be appreciated that a similar button may also be provided on the inside of the frame, for opening and closing the door 642 from within the internal volume. However, this arrangement is not essential and other arrangements such as a cable driven foot pedal could be used.

The use of a suitable body 620 can allow a sufficient a degree of isolation to be provided to significantly reduce infection rates. For example, whilst the apparatus could be hermetically sealed, this is not essential, and more typically the apparatus is designed merely to help provide a barrier to contamination by at least one of solid, contact, fluid and droplet-borne contaminants. As part of this, a lower edge of the body may be adapted to engage a surface, such as a floor, on which the apparatus is arranged, thereby preventing contaminants passing between the body and the floor. This could be achieved using a variety of techniques, such as through the use of an adhesive arrangement, as will be described in more detail below, although alternatively a weighted arrangement or similar could be used.

Additionally, the apparatus acts as a warning to individuals that the isolated subject is infectious or suspected of being infectious, thereby serving to remind individuals regarding hygiene requirements, such as hand washing and the like, which further helps protect against contact transmission. Thus, even without hermetic sealing, the apparatus 600 operates to significantly reduce the opportunity for infection, for example through contact or droplet transmission.

The above arrangement allows the body to be formed of a suitable flexible sheet material, such as a water resistant fabric, plastic sheeting, or the like, meaning the body can be lightweight and cheaply manufactured, and allowing the body to be disposed of following use. The use of a disposable body can further help reduce incidences of infection. However, it will be appreciated that non-disposable tent bodies could be used, for example when performing UV sterilisation.

Furthermore, use of a suitable door and door actuator can allow ingress and egress without a user being required to touch the door, which can further assist in reducing spreading of infectious materials. For example, this can allow hands free operation of the curtain door, enabling users to open and close the door without having to touch the door.

Additionally, the system can be used for disinfection purposes, for example allowing equipment, beds or the like to be provided in the internal volume and disinfected using UV radiation or similar.

Furthermore, in the collapsed configuration, the frame can act as a trolley, allowing items and the apparatus 600 to be stored thereon and then transported as required, for example allowing this to be moved around a medical facility as required.

A number of further features will now be described.

The apparatus 600 includes panels 651, 652, which include one or more mountings incorporated therein. The first panel 651 includes at least one mounting for receiving medical items, shown generally at 651.1, 651.2, 651.3, 651.4, 651.5, whilst the second panel 652 can act as a notice board, and can also include mountings (not shown) for receiving medical items or equipment.

When the apparatus 600 is in the operative configuration, the panels 651, 652 are arranged on either side of the door, thereby providing users easy access to stored items and information on the notice board. When the frame 610 is in the collapsed configuration shown in FIG. 6C, the panels can be provided on an outside of the frame 610, thereby allowing items to be retained mounted on the panels. This allows the apparatus to function as a trolley, allowing items and the apparatus 600 to be stored thereon, and moved around a medical facility as required. Furthermore, in this example, the first panel 651 is attached to the frame 610, so that when the frame is raised, the first panel 651 remains in a lowered position, and a similar arrangement may also be used for the notice panel 652, so that this remains in a lowered position when the frame 610 is raised. It will be appreciated that this reduces the weight of the frame 610 that needs to be lifted, as well as helping maintain a lower centre of gravity, which improves stability.

An example of the frame 610 will now be described in more detail with reference to FIGS. 7A to 7E.

In this example, the frame 610 includes five upright legs 701, 702, 703, 704, 705, interconnected by three lateral connecting members 721, 722, 723 and a collapsible curtain rail 725 that extends across a front of the frame 610 to support the curtains 642, in use. The leg 705 is coupled to the leg 704, by the first panel 651 and a secondary panel 708, extending laterally between the legs 704, 705. The leg 705 is positioned between the legs 702, 704, extending partially across a front of the frame 610 to thereby provide additional support for the door 642, as well as to support the door actuator 640.

Figure 7A:
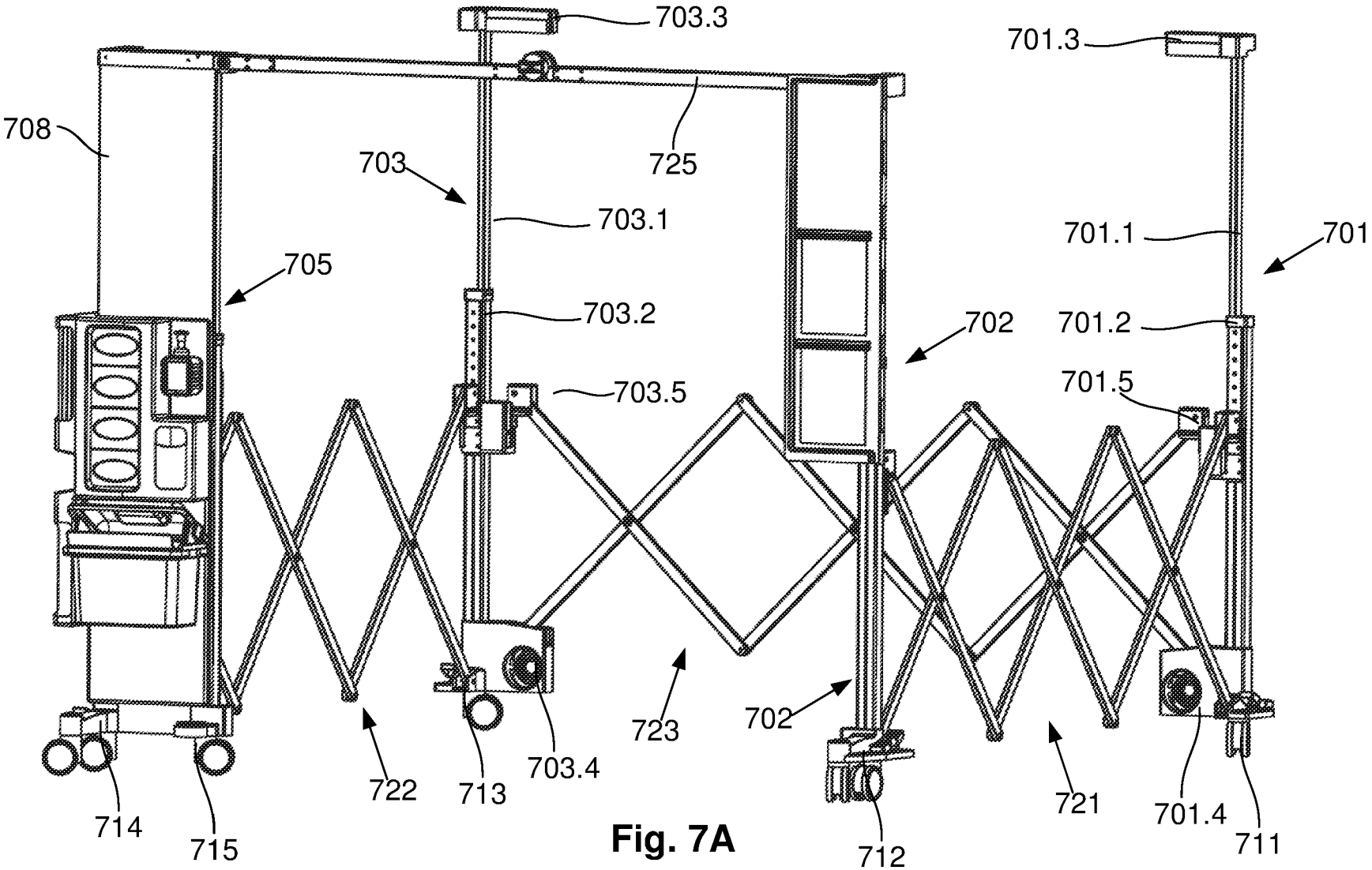
FIG. 7A is a first schematic perspective view of an example of the frame of the apparatus of FIG. 6A in an erected configuration.
Figure 7C:
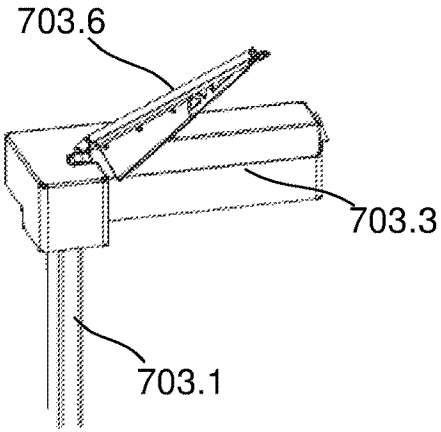
FIG. 7C is a schematic perspective view of one of the roof supports of FIG. 7B.
Figure 7B:
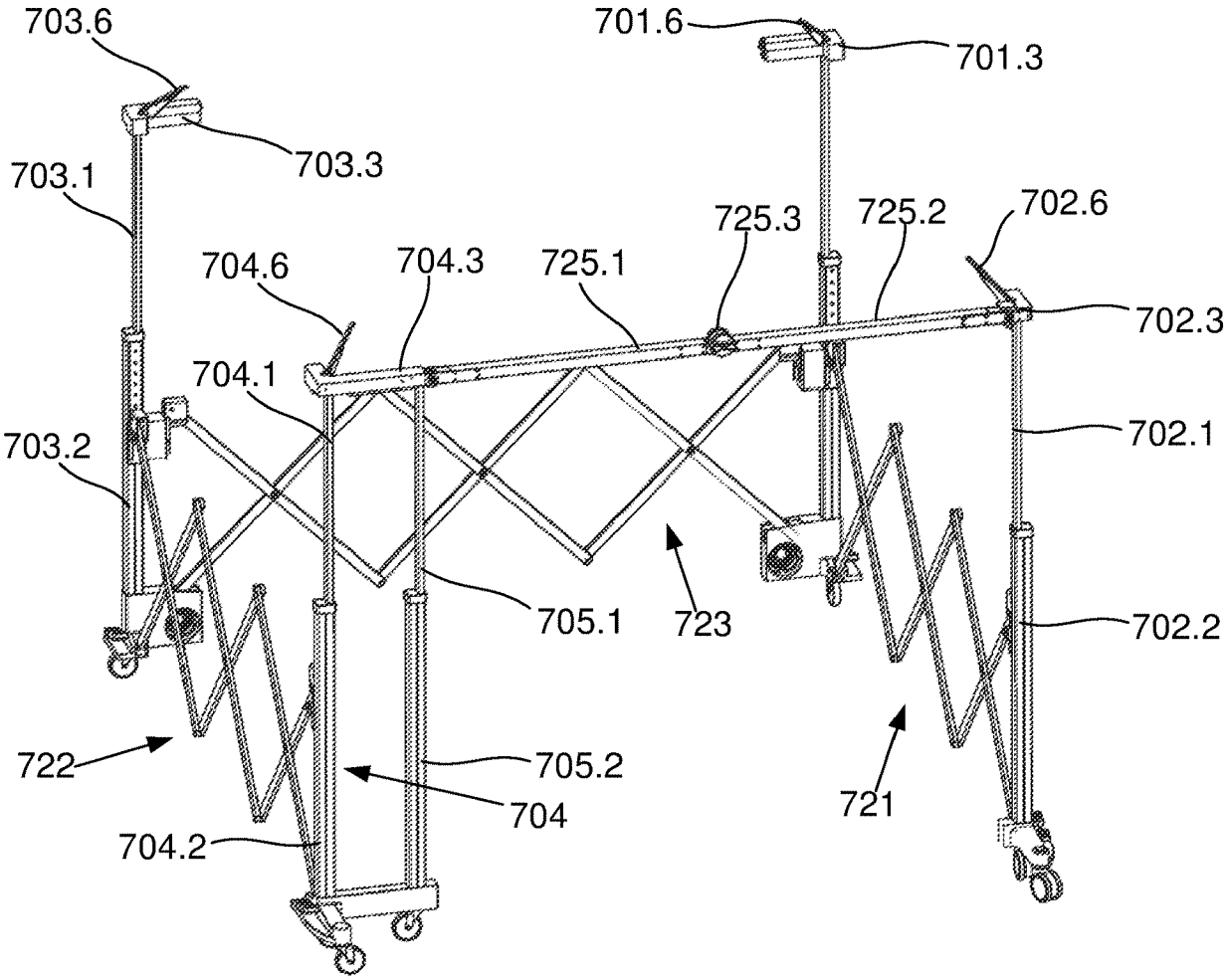
FIG. 7B is a second schematic perspective view of an example of the frame of the apparatus of FIG. 6A in an erected configuration.
Figure 7D:
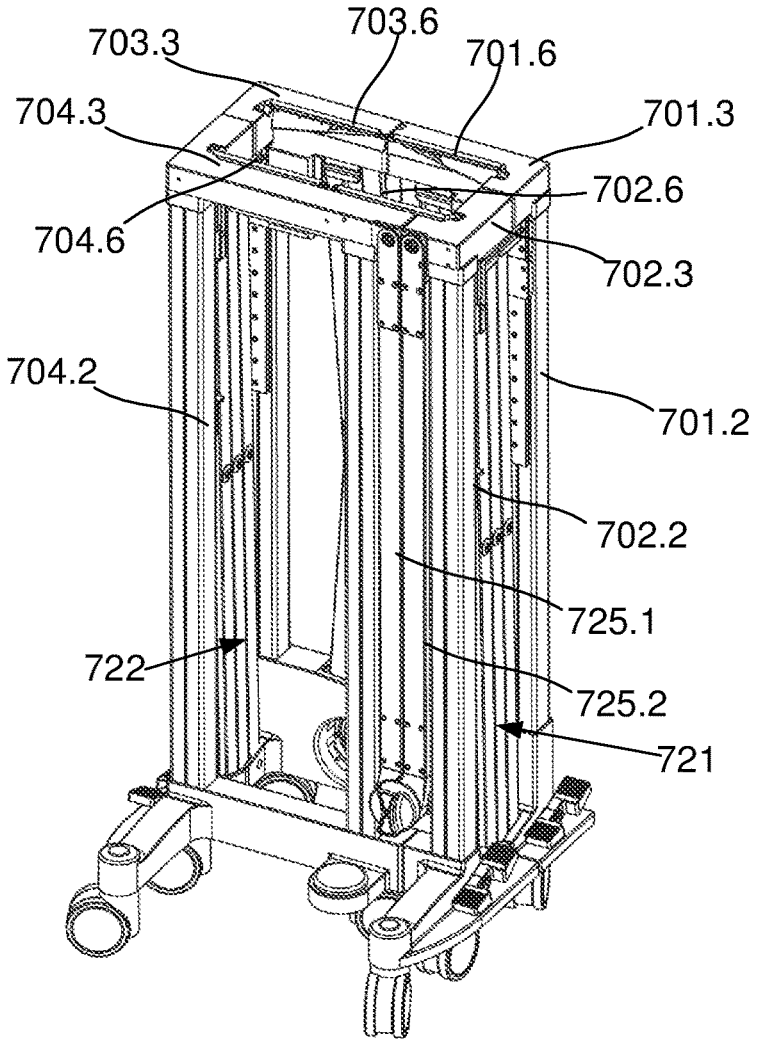
FIG. 7D is a schematic perspective view of the frame of FIG. 7A in a collapsed configuration.

The legs 701, 702, 703, 704, 705, may be made of multiple sections 701.1, 701.2, 702.1, 702.2, 703.1, 703.2, 704.1, 704.2, 705.1, 705.2, and are telescopic and optionally biased, allowing the frame 610 to be moved between a raised position, shown for example in FIG. 7A, and lowered position, shown for example in FIG. 7D. In this example, the panel 651 is attached to lower portions 704.2, 705.2 of the legs 704, 705, whilst the secondary panel 708 is attached to upper sections 704.1, 705.1 of the legs 704, 705. As a result of this configuration, the first panel 651 that supports medical equipment remains in a lowered position, whilst the secondary panel 708 is raised. This minimises the weight that needs to be raised, whilst ensuring that legs 704, 705 are interconnected along their length, thereby improving structural rigidity.

The connecting members 721, 722, 723 include pairs of pivotally connected scissor arms attached to the legs 701, 702, 703, via fixed and movable brackets allowing the scissor arms to move between an extended position, shown for example in FIG. 7A, and retracted positions, shown for example in FIG. 7D. The legs 701, 703 include shrouds 701.4, 701.5, 703.4, 703.5 for receiving ends of the connecting member 722, when in a retracted position. Lower shrouds 703.4, 701.4 may also support fan/filter arrangements for filtering air exiting or entering the internal volume 630.

However, in this example, the connecting members 721, 722, 723 are mounted to the leg lower sections 701.2, 702.2, 703.2, 704.2, 705.2, so that the connecting members 721, 722, 723 are not raised as the legs are raised into the raised position. This helps maintain a lower centre of gravity, and provides additional stability in use. Despite this, once the body 620 is fitted, the combination of the body 620 and collapsible curtain rail 725 can help ensure the frame 610 has sufficient structural rigidity.

It will be noted that in one example, the scissor arms of the connecting members 721, 722, 723, on adjacent sides of the frame are independent, meaning the frame can be expanded in first and second orthogonal directions independently. For example, the frame can be extended width wise across the bed and then subsequently extended lengthwise along the bed, as will be described in more detail below.

The collapsible curtain rail 725 typically includes two rail members 725.1, 725.2, having first ends hingably coupled to the frame 610, for example to the legs 702, 705, and second ends interconnected by a hinge 725.3. The rail can incorporate a cable opening/closing mechanism, although alternative arrangements can be used. A specific example curtain rail including such an alternative arrangement will be described in more detail below.

The frame 610 typically includes groups of one or more wheels 711, 712, 713, 714, 715, mounted on respective legs 701, 702, 703, 704, 705, and can be of any suitable form such as lockable castor wheels, or the like, allowing the frame 610 to be movably or fixedly supported on a surface.

Figure 7E:
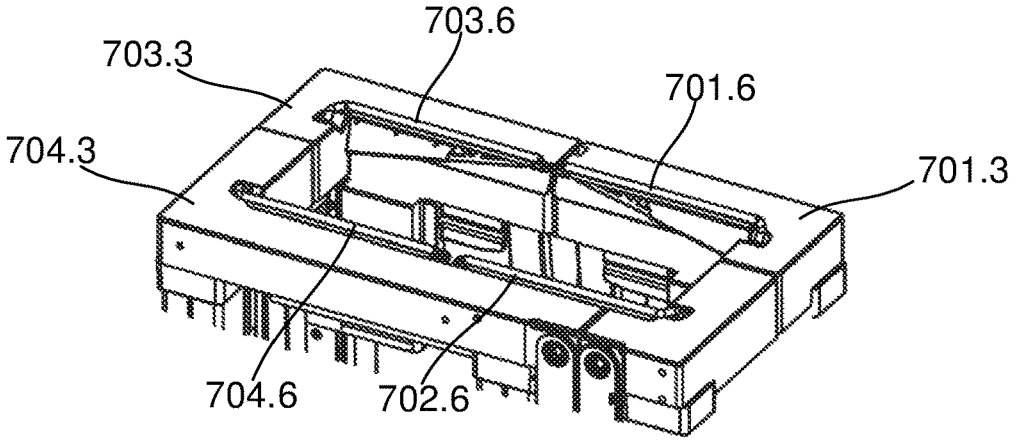
FIG. 7E is a schematic perspective view of the roof supports of FIG. 7D in a retracted configuration.

In this example, the legs 701, 702, 703, 704 include a top piece 701.3, 702.3, 703.3, 704.3, that in use receives roof supports 701.6, 702.6, 703.6, 704.6, for supporting a roof of the body 620. The roof supports 701.6, 702.6, 703.6, 704.6, typically form part of the roof. If the body is installed when the frame is in a collapsed configuration, the roof supports would be pivotally biased towards a retracted position, as shown in FIGS. 7D and 7E. However, when the frame is in an erected configuration shown in FIGS. 7B and 7C, the body applies a force to the roof supports, so that the roof supports pivot into the raised position as shown. It will be appreciated that biasing of the roof supports towards the retracted position tensions and hence supports the roof in use, whilst also raising the roof to increase the height of the internal volume. It will be appreciated however from the following description that roof supports are not required, and these are merely an optional feature.

Figure 8A:
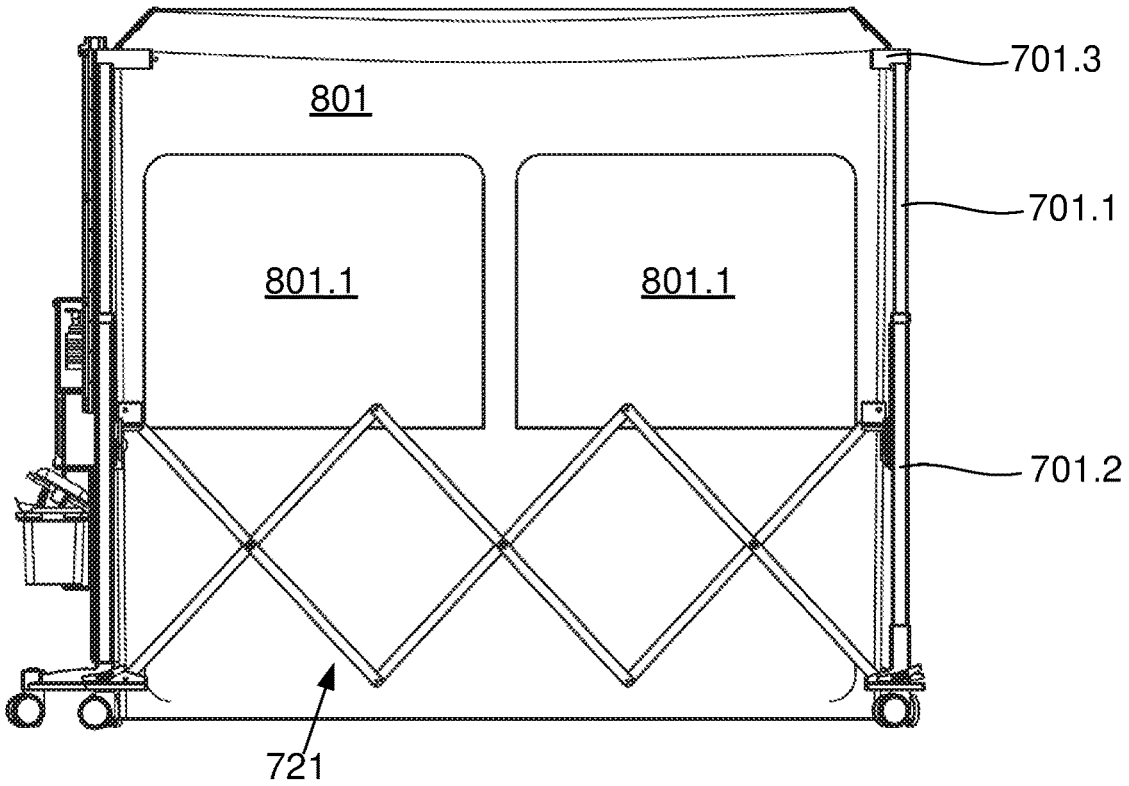
FIG. 8A is a schematic side view of the apparatus of FIG. 6A.
Figure 8B:
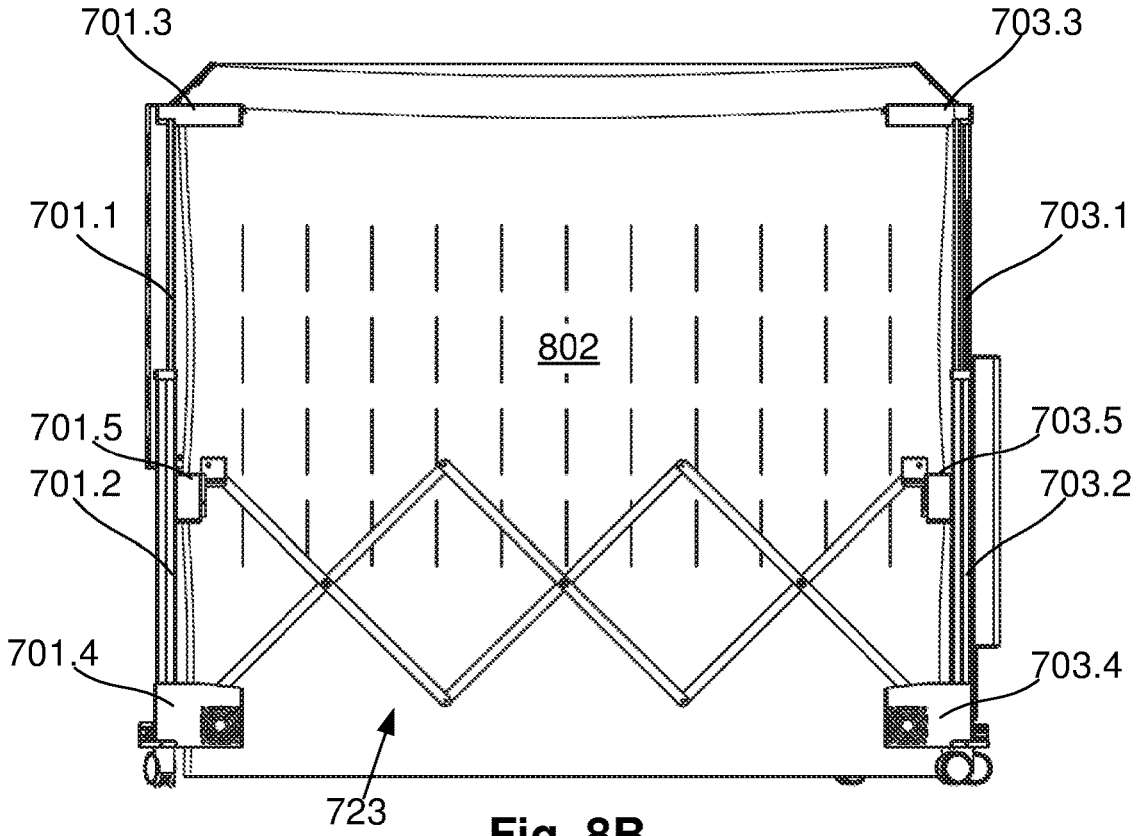
FIG. 8B is a schematic rear view of the apparatus of FIG. 6A.
Figure 8C:
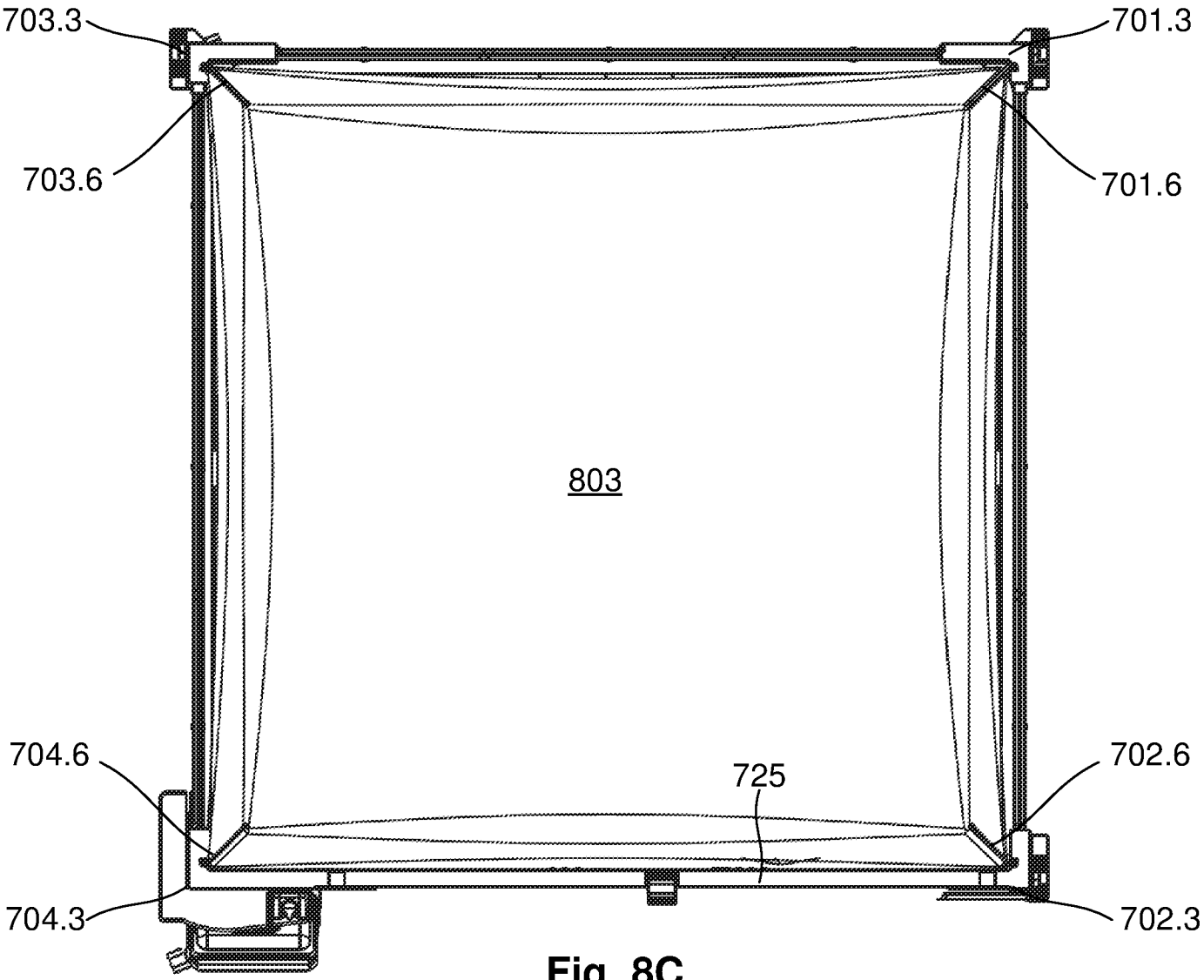
FIG. 8C is a schematic plan view of the apparatus of FIG. 6A.

In this regard, as shown in FIGS. 8A to 8C, the body 620 typically includes a roof member 803 and a number of walls 801, 802 extending between a supporting surface and the roof member 803 when the apparatus 600 is in the operative configuration.

In this example, the roof 803 the roof supports 701.6, 702.6, 703.6, 704.6 are attached to corners of the roof as shown, for example using fasteners or the like. However it will be appreciated that alternatively other arrangements could be used, for example by having the roof supports mounted to the frame and then removably attached to the roof in use. When the body 620 is fitted to the frame 610, the roof supports 701.6, 702.6, 703.6, 704.6 are coupled to the top pieces 701.3, 702.3, 703.3, 704.3, with the roof supports 701.6, 702.6, 703.6, 704.6 being biased to thereby tension and raise the roof, and hence help support the roof, when the roof is in an erected configuration.

The process for erecting the apparatus 600 to isolate a bed will now be described with reference to FIGS. 9A to 9E.

The bed 631 is initially moved outwardly from the wall 900. The body 620 is coupled to the frame by inserting the roof supports 701.6, 702.6, 703.6, 704.6 into the top pieces 701.3, 702.3, 703.3, 704.3. The apparatus 600 is moved near the wall 900, next to the bed, with the wheels outermost from the bed or optionally just the outermost rearward wheel 711, being locked and the legs 701, 702, 703, 704, 705 raised, as shown by the arrow 901.

The frame 610 is then extended in the direction of arrow 902, by pulling the legs 701, 702, so that the frame 610 extends between the bed 631 and the wall 900. It will be appreciated that the frame 610 must be extended behind the bed first so that the connecting member 723 can be position between the bed 631 and wall 900. During this process, the curtain rail 725 unhinges and once the frame is fully extended, the user can check the connecting member 723 and the curtain rail 725 are fully extended and locked in position, as shown at 903. If the body 620 is fitted, it can then unfold as shown by the arrow 904 so it passes between the bed 631 and the wall 900. If used, a notice board panel 652 can also be swung outwards as shown by the arrow 905. Next, if necessary the wheels 712, 714, 715, are unlocked and the frame 610 is wheeled over the bed 631, as shown by the arrows 906, making sure the connecting members 721, 723 are full extended and locked in position.

Figure 9A:
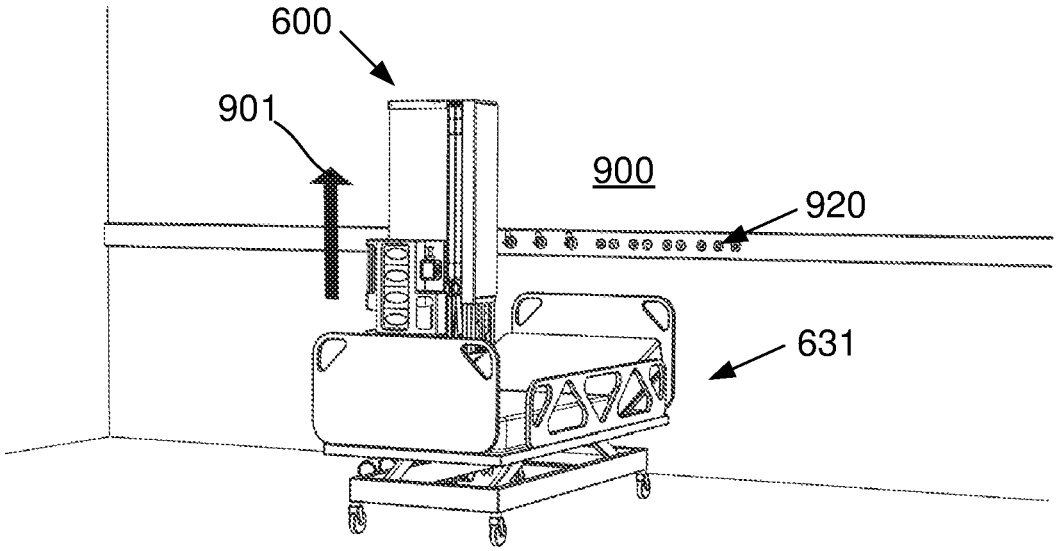
FIGS. 9A to 9E are schematic diagrams showing a method of erecting the apparatus of FIG. 6A to isolate a patient bed.
Figure 9B:
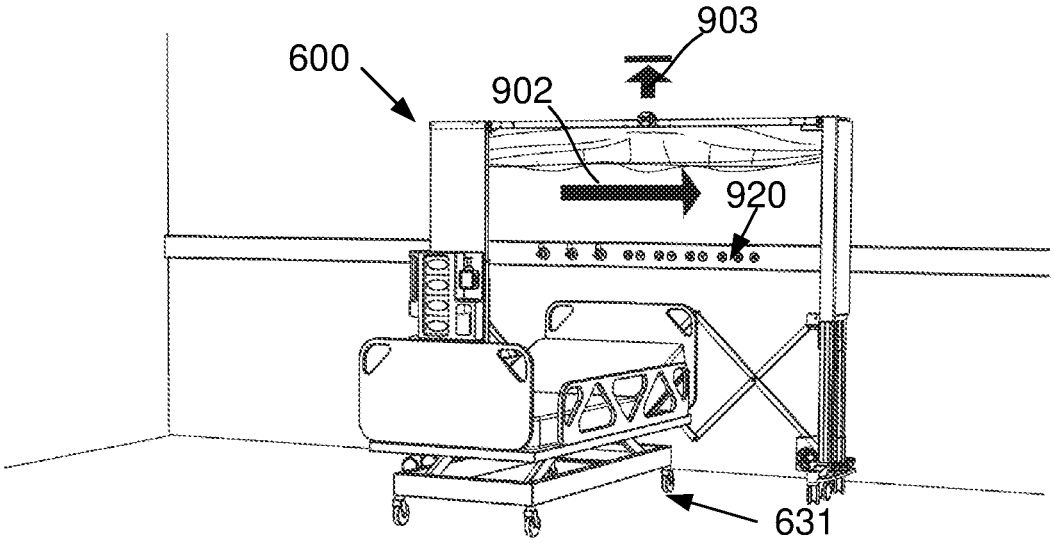
Figure 9C:
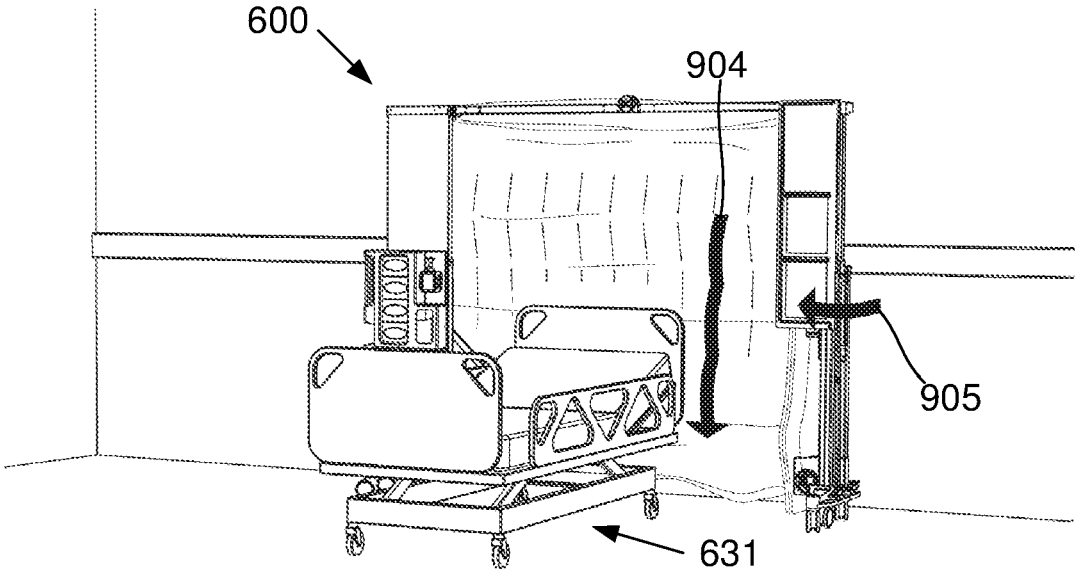
Figure 9D:
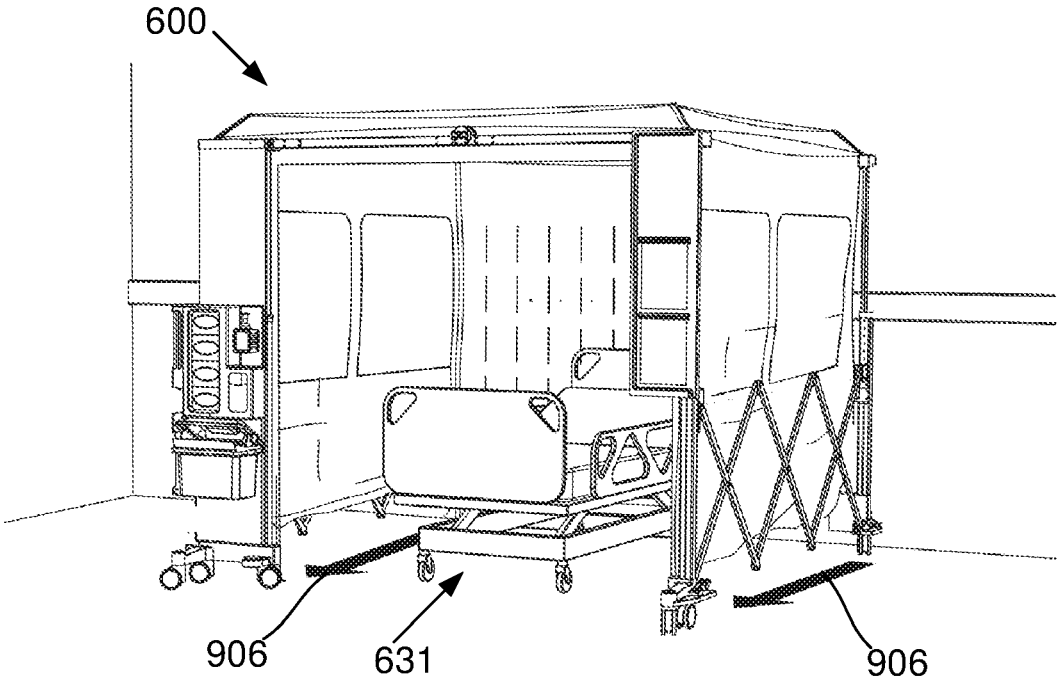
Figure 9E:
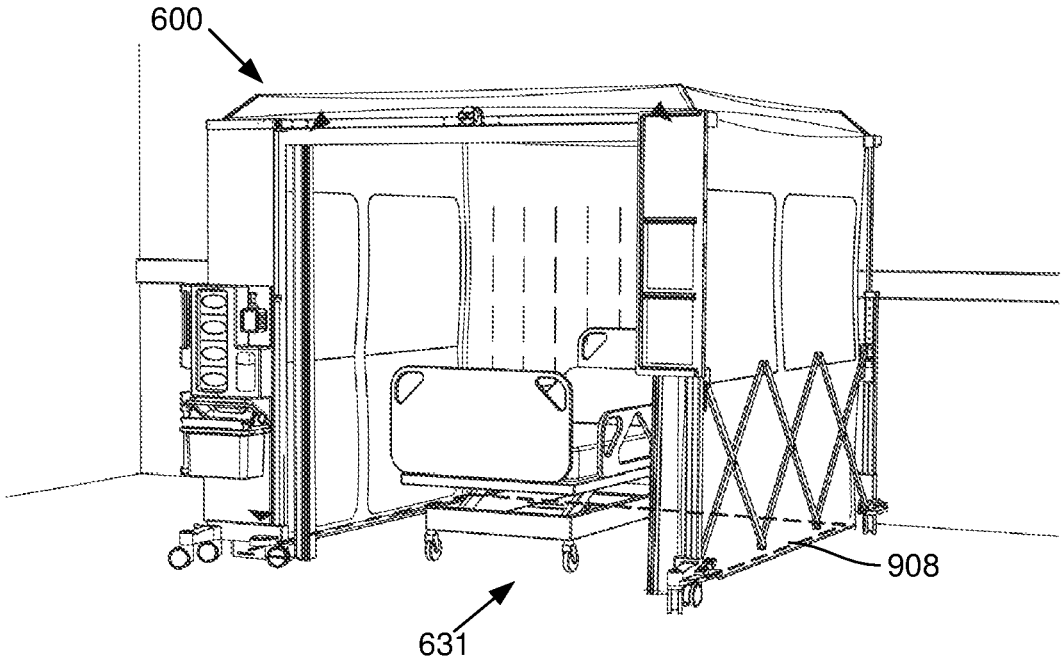

The body 620 can be secured to the legs 701, 702, 703, 704, before the side and rear walls 801, 802 are attached to the floor with double sided or otherwise attached adhesive tape, as shown by the dotted line 908 in FIG. 9E. In one example, the adhesive tape is fixed to the walls of the body during manufacture, so that the user need simply remove a cover layer from the tape, and apply the tape directly to the floor. Following this, the curtains 642 are attached to the curtain rail 725 and connections to necessary equipment (e.g. wall oxygen) 920 can be accessed through openings created using perforations in the rear wall of the body 620.

The above described process also allows the frame 610 to be erected over the bed 631, with the patient optionally remaining in situ. This avoids the need to move the patient, which can increase the risk of infection to other individuals in the vicinity, as well as potentially adversely affecting the health of the patient.

Figure 1B:
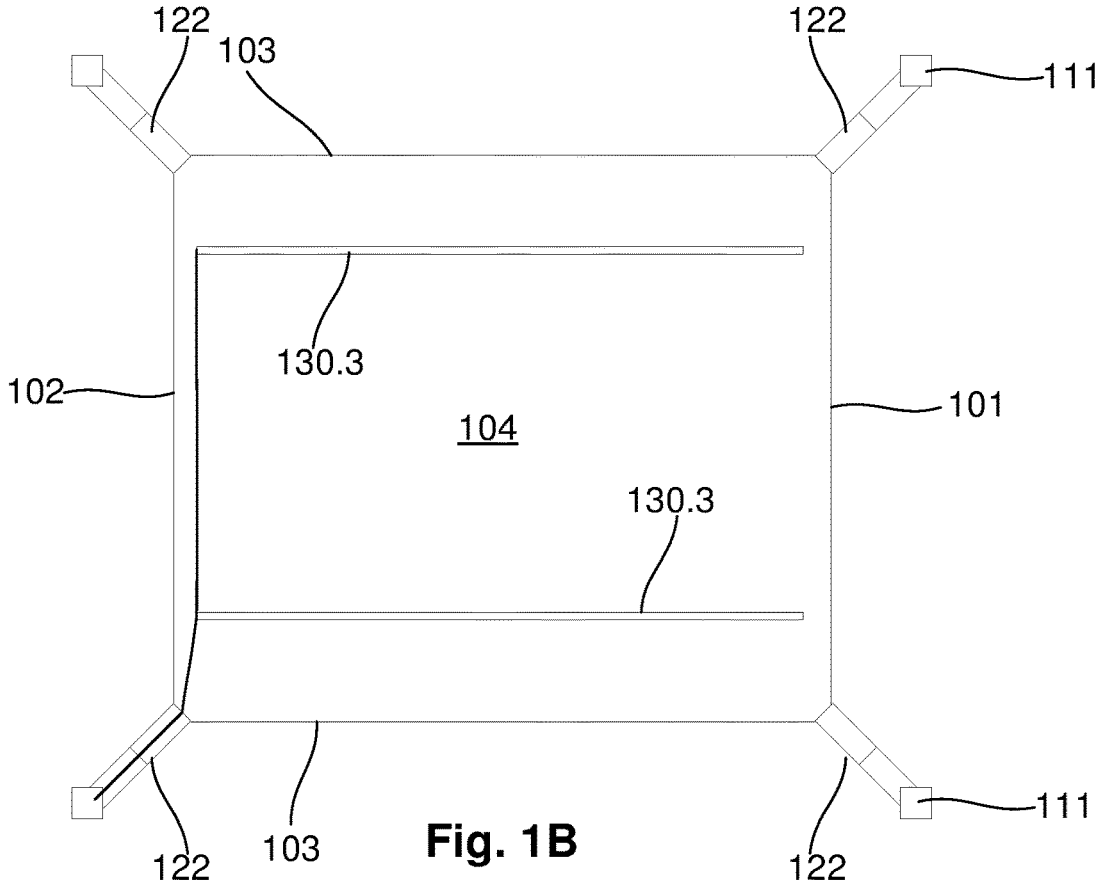
FIG. 1B is a schematic plan view of the isolation apparatus of FIG. 1A.
Figure 1C:
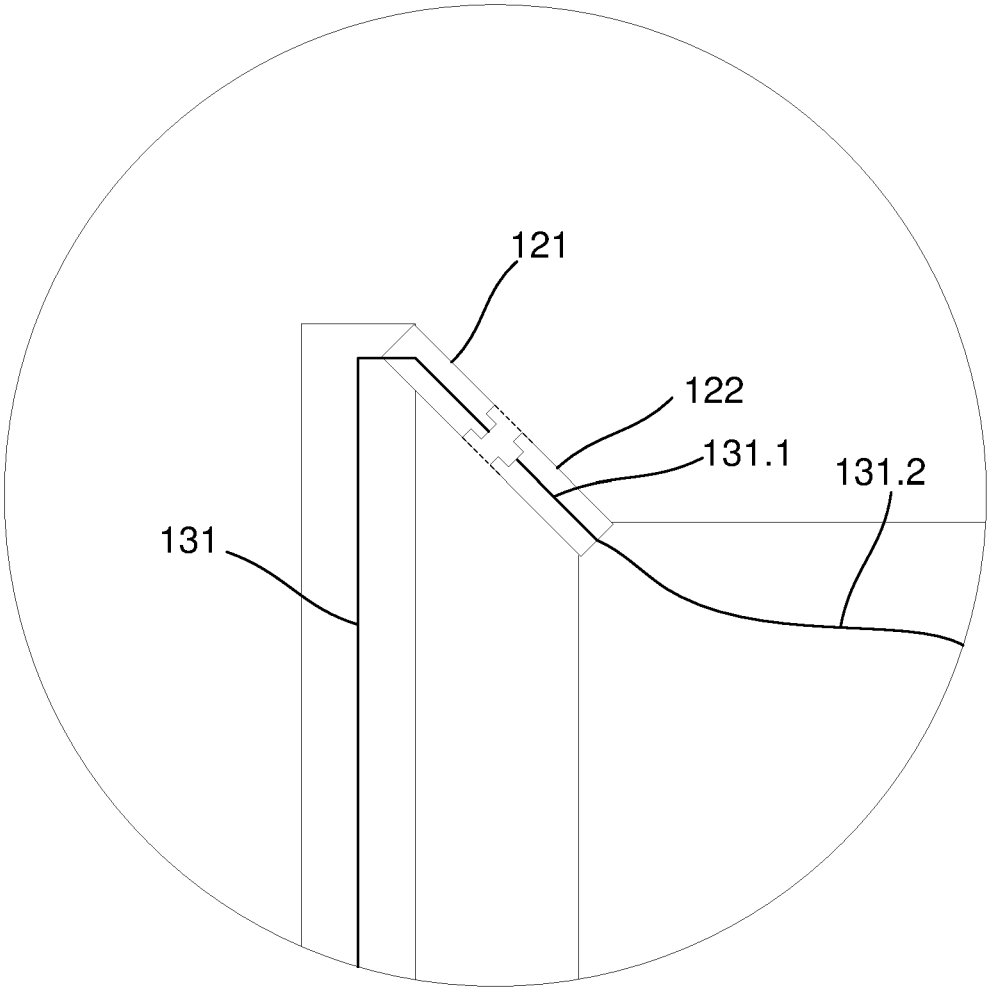
FIG. 1C is a schematic close up side view of a connector of FIG. 1A.

A number of different embodiments of the isolation tent encompassing different aspects of the invention will now be described. Each of these aspects are typically implemented as part of an isolation tent shown in FIGS. 1A and 1B, which will now be described in further detail.

In this example, the isolation tent includes a body 100 having a roof member 104 and at least one wall extending between a supporting surface (not shown) and the roof member 104 to thereby at least partially define an internal volume substantially isolated from a surrounding environment. In this example, the isolation tent 100 has a substantially cuboid shape, with substantially parallel front and rear walls 101, 102, interconnected by two parallel side walls 103. As in the example arrangement described above with respect to FIGS. 8A to 8C, the front wall 101 could include doors providing access to the internal volume, or could include an opening, allowing doors to be provided separately. In this latter case, it will be appreciated that the front wall 101 could be an at least partially open wall, and use of the term wall is not intended to be limiting in this regard. It will also be appreciated that this arrangement is for the purpose of illustration only, and in practice other shapes could be used.

The isolation tent further includes a plurality of connectors 122 coupled to the body. The plurality of connectors is adapted to engage a frame 110, for example to physically attach the body to the frame. The frame 110 can be of any suitable form, but typically includes at least four upright legs 111 for supporting respective corners of the isolation tent. In one particular example, the frame 110 is similar to the frame described above with respect to FIGS. 7A to 7E and is movable between collapsed and erected configurations, with the frame including a number of upright legs and a number of lateral connecting members interconnecting the legs, the connecting members including scissor arms movable between retracted and extended positions and wherein scissor arms on adjacent sides of the frame are independent so that the frame can be extended in a first direction and then subsequently in a second direction orthogonal to the first direction.

The isolation tent body is typically a disposable single use body at least partially made from a flexible water resistant sheet material, although other suitable materials could be used. In one example, the roof member comprises a flexible air permeable but water insoluble sheet material, allowing airflow into and out of the tent, although this is not essential and other configurations could be used, for example allowing airflow to occur via specific filters or the like. The wall members are typically a water resistant sheet material, to prevent liquid passing therethrough, although again other suitable arrangements could be used. The body may also incorporate one or more transparent panels providing windows, although this is not essential. The body is typically removably mounted inwardly of the frame, in use, allowing the body 100 to be suspended by the connectors 122, although any suitable arrangement could be used.

In a first aspect of the invention, shown in further detail in FIGS. 1A to 1D, the isolation tent includes one or more electrical components, with three different example electrical components 130.1, 130.2, 130.3 being shown for the purpose of illustration. The electrical component could be of any appropriate form and examples include electrical conductors 130.1 for conducting electrical signals at least part way across the isolation tent body 100, data storage devices 130.2 for storing data, or lighting elements 130.3 such as roof mounted LED strips, or the like. However, it will be appreciated from the following description that a wide range of other electrical components could be incorporated into the isolation tent body, such as sensors, indicators, or the like, and the examples provided are for the purpose of illustration only and are not intended to be limiting. The electrical components 130 could be attached to or incorporated into the body 100, and in one example, may form part of the connectors 122, as will be described in more detail below.

In use, the connectors 122 are used to allow electrical signals to be transferred to or from the electrical component. Typically this is achieved by having at least one electrical connection 131 provided within the frame 110, for example extending through one of the legs 111, allowing the signals to be delivered to the connectors 122, and then transferred via internal electrical connections 131.1, 131.2, to the electrical components incorporated into the tent body.

The electrical signals could be of any appropriate form and could include power signals, such as low voltage power signals, which may be obtained from a power supply 132, such as a transformer, optionally mounted on the frame 110. However, alternatively the signals could be communications signals received from a processing device or similar, or control signals used to control operation of the electrical component, as will be described below.

Accordingly, the above described arrangement includes an isolation tent with an integrated electrical component, which can be used to provide additional functionality, such as conducting signals, allowing storage and download of data, or the like. The connectors used to physically attach the isolation tent body to the frame are further used to provide electrical connectivity, thereby allowing components to be automatically connected to corresponding components or other circuitry in the frame, when the isolation tent body is attached to the frame as part of the normal process of deploying the isolation apparatus, as described above with respect to FIGS. 9A to 9E. Thus, by allowing electrical connections to be provided via the same connectors that are used to physically connect the isolation tent body to the frame, this reduces the steps required to setup the isolation system, whilst ensuring required functionality is provided.

A number of further features associated with the first aspect of the invention will now be described.

Figure 1D:
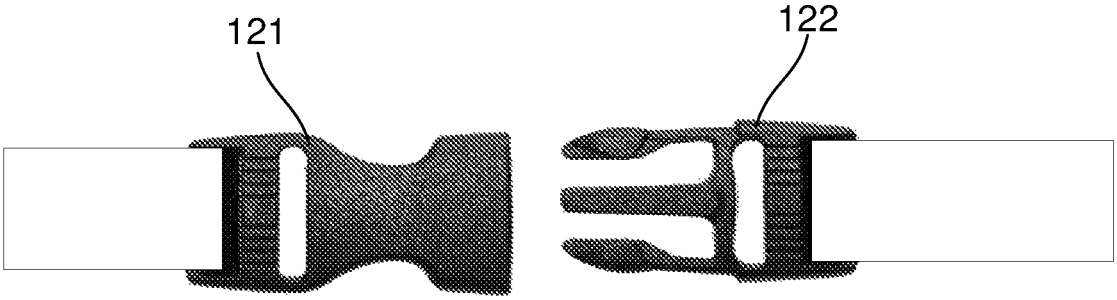
FIG. 1D is a schematic diagram of an example of a buckle connector.

In one example, the connectors form part of a connector system, with the connectors being adapted to physically couple to corresponding frame connectors 121 mounted to or forming part of the frame. Thus, the frame can include frame connectors 121 which attach to a corresponding connector 122 mounted to the isolation tent body 100, to thereby physically secure the isolation tent to the frame. The connectors 121, 122 could be of any appropriate form, and typically include complementary connectors, such as a plug and socket, or buckle arrangement as shown in FIG. 1D. Thus it will be appreciated that the connectors can be interconnected using any appropriate connection mechanism, such as a friction fit, a hook and eye, a clip fit, interference fit or the like. The connectors can be attached directly to the frame and tent body, or could be attached via intermediate members, such as straps or the like, depending on the preferred implementation.

In one example, the connectors have a complementary shape, such that they are only able to be physically coupled if the correct shape connectors are provided. This can function in a similar manner to a lock and key type configuration, so that the connector has to be insertable into and turned within the frame connector to physically couple the connectors. This prevents tent bodies with an incorrectly shaped connector being used. In a similar manner, a respective configuration of connector could be used for each of the connectors, thereby ensuring that the tent body is attached to the frame in a desired orientation. Alternatively visual indications, such as colour coding of the connectors, could be used to assist with correct orientation.

In another example, the connector includes a pin and the frame connector includes a socket, wherein the pin is inserted into the socket to couple the frame connector to the frame. In this instance, the socket includes a catch to secure the pin, and thereby retain the connector coupled to the frame connector, and a release mechanism, such as a button, to selectively release the pin and thereby allow the tent to be decoupled from the frame following use.

The frame connectors 121 incorporate electrical connectors 131, such as wires, that extend through the frame, allowing the frame connectors 121 to be electrically connected to respective electrical components mounted to the frame 110, such as a power supply 132, door actuator system 133, processing device, or the like. This allows connections to be provided between electrical components mounted to the frame and those integrated into the isolation tent body.

In one example, the electrical component is at least one conductor 130.1 extending at least part way across the body, the conductor being electrically connected to at least one of the connectors 122 to allow electrical signals to be conducted via the connector(s) 122 and the at least one conductor 130.1. For example, the conductor can be electrically connected to connectors 122 on either side of the body, allowing electrical signals to be transferred across the body, for example allowing signals to be transmitted from one side of the frame to another. The nature of the signals will vary depending on the preferred implementation, and could include data communications signals, electrical power supply signals, or the like. For example, one of the frame connectors 121 can be electrically connected to an electrical power supply 132 mounted on a rear side of the frame 110, with another frame connector 121 being electrically connected to electrical equipment 133 mounted to a front side of the frame 110 so that the electrical equipment can be powered by the electrical power supply. This is particularly beneficial as transmitting signals across the frame can be difficult given the configuration of the frame, particularly if scissor arms are used to interconnect the upright legs.

The nature of the conductor 130.1, or any of the conductors used, will vary depending on the preferred implementation. For example, the conductor could include wires, such as metal wires, embedded in or attached to the body, silver plated nylon conductors provided on a surface of the body, silver plated nanowire conductors provided on a surface of the body, electrically conductive tracks printed on or otherwise applied to the body, such as conductive material printed on, sewn to, embedded within or adhered to the body. In one example, the conductor 130.1 extends at least partially along a seam between the wall and the roof. This region of the body is typically more robust, and this can assist in ensuring conductor integrity, in particular ensuring the conductor does not become damaged during erection of the isolation tent.

In another example, the electrical component includes lighting 130.3 for illuminating the internal volume. The lighting could be of any appropriate form, and could include LED strips, or the like, with these optionally extending across an underside of the roof 104 and/or along seams between the roof and the wall(s).

In another example, the electrical component includes a tag including a memory, allowing data to be stored thereon, and retrieved when the tent is coupled to the frame. The tag can be mounted within the roof and/or side walls of the tent body, or could be incorporated into one of the connectors 122. This can be used to retrieve information regarding the tent, for example to control operation of the isolation apparatus. Alternatively, this can be used as part of a verification process, and an example of such a process will now be described in further detail.

In particular a second aspect of the invention can provide a verification process that is used in order to verify the isolation tent body prior to or during use. The verification process can be used to ensure that the isolation tent body is a genuine product, and hence suitable for use with a particular frame and also able to provide a required degree of isolation. The verification process can also be used to track isolation tent usage, which could be used in a number of ways. For example, this could be used to ensure isolation tent bodies are not re-used, which could in turn lead to issues regarding contamination of subjects or the like. It will be appreciated that in implementing this, rules may need to be applied to ensure the tent is usable in the event of a power disconnection. Tracking could also be used to limit the length of time for which an isolation tent body is used, for example ensuring the tent body is replaced every 30 days or so, to thereby prevent build-up of infectious material, or the like.

Figure 2:
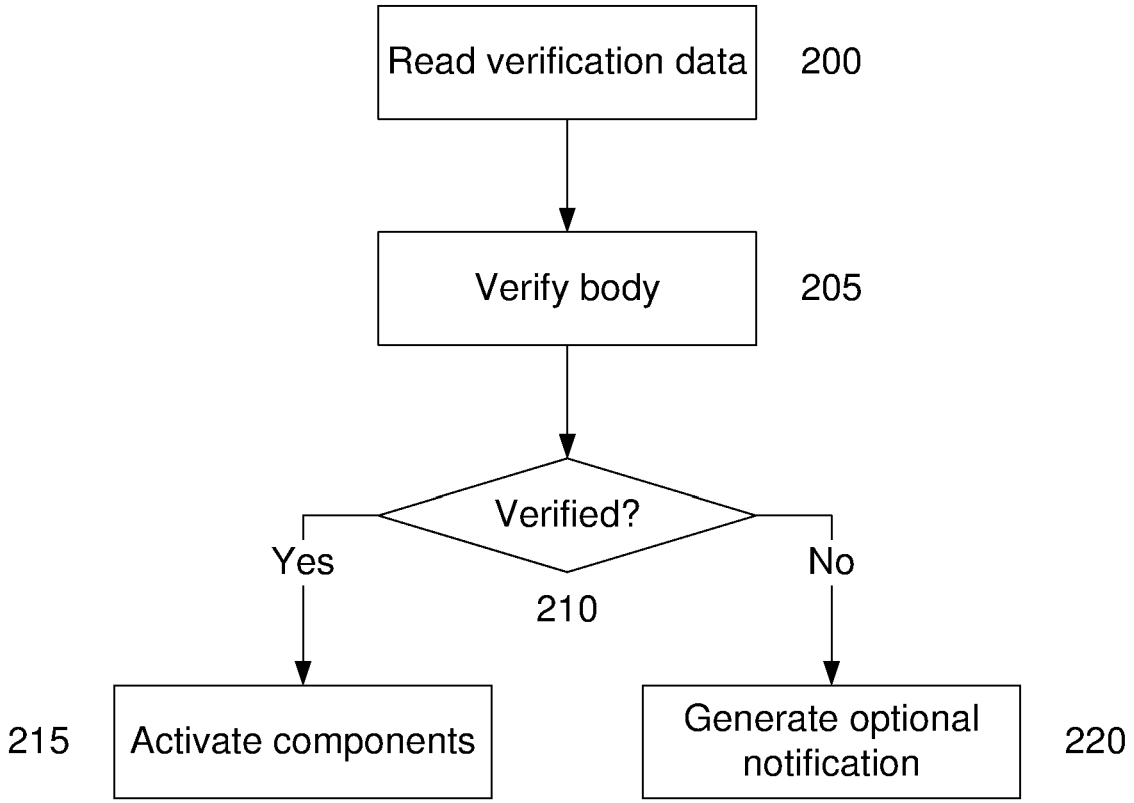
FIG. 2 is a flow chart of an example of an isolation tent verification method.

An example of a verification process will now be described with reference to FIG. 2.

For the purpose of illustration, it is assumed that the process is performed at least in part using one or more electronic processing devices, optionally forming part of one or more processing systems, which may be integrated into the frame and/or which may optionally be remotely provided and in communication with the isolation apparatus as needed.

In this example, at step 200, verification data is read from the tent. The nature of the verification data and the manner in which this is read can vary depending on the preferred implementation. In one example, the verification data can be displayed on the isolation tent body, for example as part of a 2D code, such as a QR code, or the like, printed or otherwise displayed on the tent body, with the 2D code being read using an appropriate imaging device. Alternatively, the verification data can be stored in a memory provided in a tag attached to or embedded within the isolation tent body, with this then being retrieved by a suitable tag reader. In one example, this can be achieved wirelessly, although alternatively this could be performed via a wired connection, for example established via one of the connectors 122 as described above with respect to the first aspect of the invention.

At step 205, the verification data is used to verify the body. The nature of the verification process will vary depending on the preferred implementation and could include a variety of security protocols in order to prevent the verification data being fraudulently created and/or copied from another tent body.

For example, each isolation tent body could be assigned a unique identifier, with the unique identifier being checked to ensure this is genuine and optionally that this is the identifier assigned to the particular isolation tent body. Additionally and/or alternatively, this could also include using an encryption key or other decoding mechanism to validate a message, and in particular ensure the message was created by a legitimate supplier of the isolation tent body. For example a message containing information, such as the tent identifier could be encrypted using a private key of the supplier and then stored in the memory on the tent body. The processing device can then attempt to validate the encrypted message by decoding this with the public key and assessing whether the message is of an expected form, and to check the encrypted tent identifier matches an unencrypted tent identifier. The verification process could also involve ensuring the isolation tent body has not been previously used, or has not expired beyond a set usable time limit, for example by comparing the isolation tent identifier to a list of previously used identifiers and a known date of creation of the tent body. Examples of the verification process will be described in more detail below.

At step 210, the one or more processing devices determine if the isolation tent body has been verified and if so one or more components associated with the isolation apparatus can be activated at step 215. For example, this process can involve activating components mounted to the frame, such as a door actuator, power supply, air filter, or the like and/or activating components forming part of the isolation tent body, such as lighting or the like. This allows the isolation apparatus to function with all intended functionality.

If the isolation tent body is not verified, then the components are typically not activated, thereby at least reducing the functionality provided by the isolation apparatus. This could extend from precluding use of the apparatus, for example, by disabling locking mechanisms in the frame, thereby preventing correct erection of the apparatus, or by disabling ancillary components, such as the power supply, air filter or the like.

Additionally and/or alternatively, a notification of failure of verification could be generated at step 220, with this being provided locally, for example through a visual or audible notification generated by the processing device, or remotely by having the processing device transfer the notification to a remote processing system. This could be used to alert a healthcare professional, or administrator of a healthcare facility, and/or a supplier of the isolation apparatus, alerting them to the fact that an attempt has been made to use an unverified isolation tent body.

Accordingly, it will be appreciated that this provides a mechanism to verify the isolation tent body, for example to ensure the isolation tent body is a genuine isolation tent body, which is important to ensure quality requirements are met and/or that the isolation tent body functions correctly with the frame, to thereby provide adequate isolation. This can also prevent isolation tent bodies being reused, which can in turn present a health hazard. Thus, the verification process can be used to verify the body to confirm at least one of the bodies is a correct body for use with a current frame, the body has not exceeded an expiry date, shelf life or defined duration of use and/or that the body has not been previously used.

A number of further features associated with the second aspect will now be described.

In one example, the verification process involves the use of an electrical component provided as part of the isolation tent body, and which can be optionally connected to the processing device(s) via a connector, in accordance with a first aspect. In this example, the electrical component includes a memory that stores verification data, and wherein the verification data is retrieved by a processing device when the body is connected to the frame, allowing the processing device to verify the body.

In addition to and/or alternatively to the use of a memory to store verification data, the isolation tent body can include machine readable verification data provided in another way. This could include for example, using a machine readable code printed on or otherwise presented on the isolation tent body, for example using visual marking, a remote readable data store, such as an RFID tag or the like. Again, the verification data can be read by a processing device using wired or wireless connections. For example this could include using a scanner or other suitable imaging device, wireless RFID tag reader or the like, so that the coded data can be read when the body is connected to the frame, allowing the processing device to verify the body.

Thus, it will be appreciated that verification data could be stored in a readable memory electrically connected to a processing device via electrical connections in the isolation tent connectors, or alternatively could be provided on the isolation tent body or an integrated RFID tag and remotely read as required.

In these examples, the isolation apparatus can also include the processing device, which reads machine readable verification data provided on the body when the body is connected to the frame, allowing the processing device to verify the body. The processing device can be used to control one or more functional components, and wherein the processing device selectively activates the functional components in response to verification of the body. The functional components can include any one or more of a door actuator that opens doors and an air filtration system. This can be used to prevent operation of the functional components in the event that the isolation tent body is not verified.

The processing device could be of any appropriate form and could include a microprocessor, microchip processor, logic gate configuration, firmware optionally associated with implementing logic such as an FPGA (Field Programmable Gate Array), or any other electronic device, system or arrangement. In one example, the processing device forms part of a controller and could include or be coupled to a processing system, such as a suitably programmed computer system or the like.

The processing device can be provided remotely to the frame or mounted to or within the frame. In one specific example, the processing device is provided within a filter unit mounted to the frame, as will be described in more detail below with respect to FIGS. 5A and 5B. In this example, the processing device can read the machine readable verification data via wired connections via a coupling between a filter unit and either the isolation tent or a filter member, although it will be appreciated that other arrangements could be used, such as reading the verification data wirelessly or via the connectors described above with respect to FIGS. 1A and 1B.

In another example, the memory can be writable allowing the verification data to be updated during use, for example, updating the verification to indicate a time and date of use of the isolation tent body, or to delete the verification data to prevent subsequent re-use of the isolation tent body.

Typically, in order to ensure security of the verification process, the verification data can include any one or more security features, and could include a digital signature, a unique reference number and/or encrypted data. Thus, the processing device can retrieve the data and verify the digital signature and/or confirm the verification data can be decrypted using a suitable decryption process.

In another example, the processing device might be required to perform the verification process at least in part by communicating with a remote server, or other computer system. For example, this can be used to look-up a unique tent identifier and ensure this is a legitimate identifier that has not been previously used.

Figure 3:
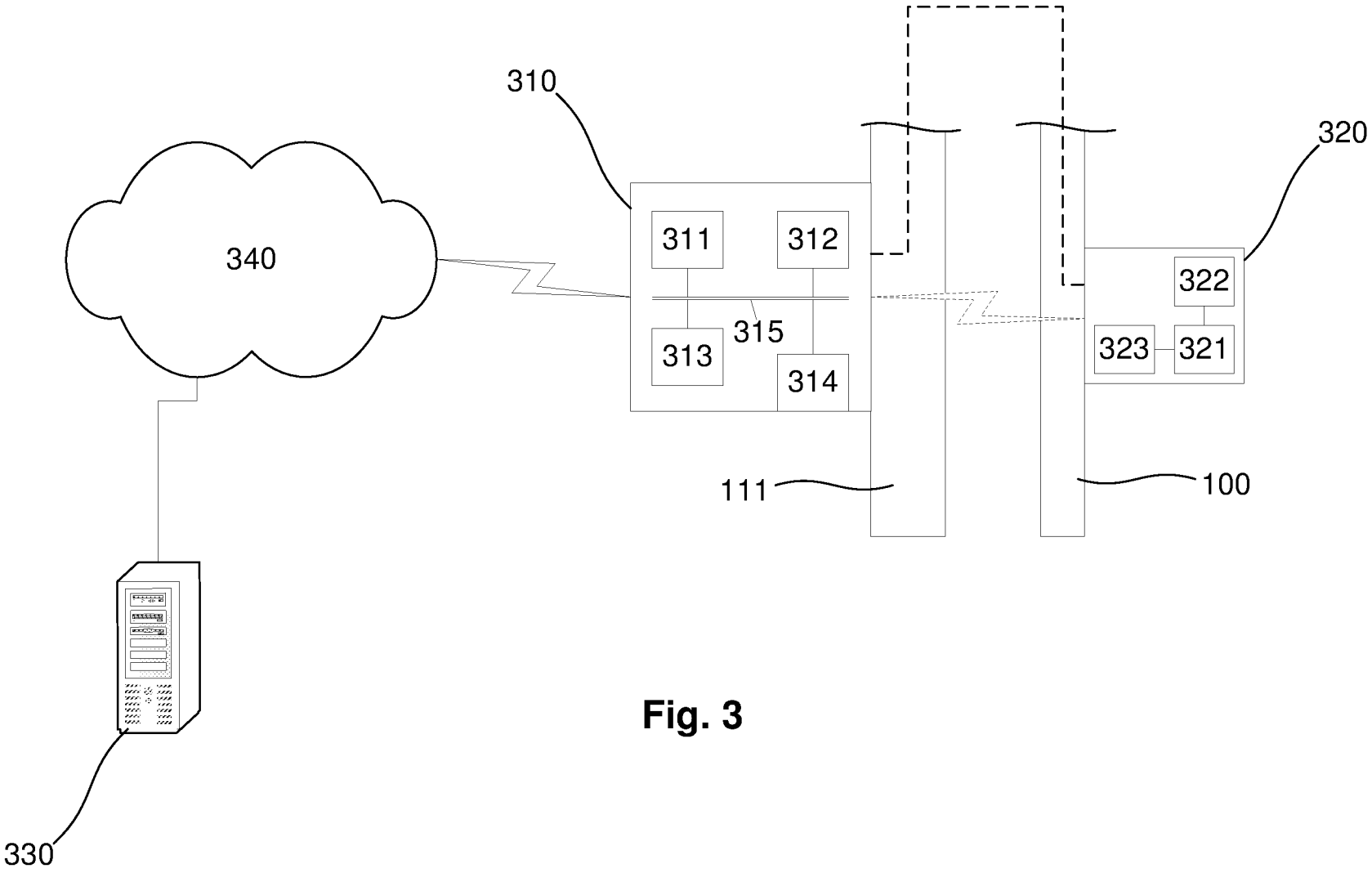
FIG. 3 is a schematic diagram of an example of an isolation tent verification system.

A specific example verification system will now be described with reference to FIG. 3.

In this example, the system includes a processing system 310 attached to the frame 110 of the isolation apparatus and a tag 320 attached to the isolation tent body 100, with the processing system 310 and tag 320 being able to communicate via a wired or wireless connection, thereby allowing the verification data to be retrieved.

The processing system 310 could be of any appropriate form but typically includes at least one microprocessor 311, a memory 312, an optional input/output device 313, such as a input buttons and/or a display, and an external interface 314, interconnected via a bus 315 as shown. In this example the external interface 314 can be utilised for connecting the processing system 310 to peripheral devices, such as the communications networks 340, the tag 320, other electrical equipment forming part of the isolation apparatus, or the like. Although a single external interface 314 is shown, this is for the purpose of example only, and in practice multiple interfaces using various methods (e.g. Ethernet, serial, USB, wireless or the like) may be provided.

In use, the microprocessor 311 executes instructions in the form of applications software stored in the memory 312 to allow the required processes to be performed. The applications software may include one or more software modules, and may be executed in a suitable execution environment, such as an operating system environment, or the like.

Accordingly, it will be appreciated that the processing system 310 may be formed from any suitable processing system, and could include any electronic processing device such as a microprocessor, microchip processor, logic gate configuration, firmware optionally associated with implementing logic such as an FPGA (Field Programmable Gate Array), or any other electronic device, system or arrangement. In one particular example, the processing device is part of a control system for the isolation apparatus, which operates to control in-built systems including an air filtration system, door actuator, power supply or the like.

The tag 320 typically includes an integrated processor 321, memory 322 and interface 323, which can be connected to an antenna (not shown), or connected to the connector 122, via a wired connection allowing wired communication with the processing system 310. The tag may also include a power supply, or alternatively this could be powered by power received from the processing system, either via a wired connection, or inductive coupling or the like. In one example the tag is a Bluetooth or RFID tag, although this is not essential and any suitable tag could be used.

The processing system 310 can also be coupled to one or more remote computer systems 330, such as a server, via one or more communications networks 340, such as the Internet, and/or a number of local area networks (LANs), allowing the computer system to participate in the verification process, as will be described in more detail below. Any number of processing systems 310 and computer systems 330 could be provided, and the current representation is for the purpose of illustration only. The configuration of the networks 340 is also for the purpose of example only, and in practice the processing systems 310 and computer systems 330 can communicate via any appropriate mechanism, such as via wired or wireless connections, including, but not limited to mobile networks, private networks, such as 802.11 networks, the Internet, LANs, WANs, or the like, as well as via direct or point-to-point connections, such as Bluetooth, or the like.

Figure 4A:
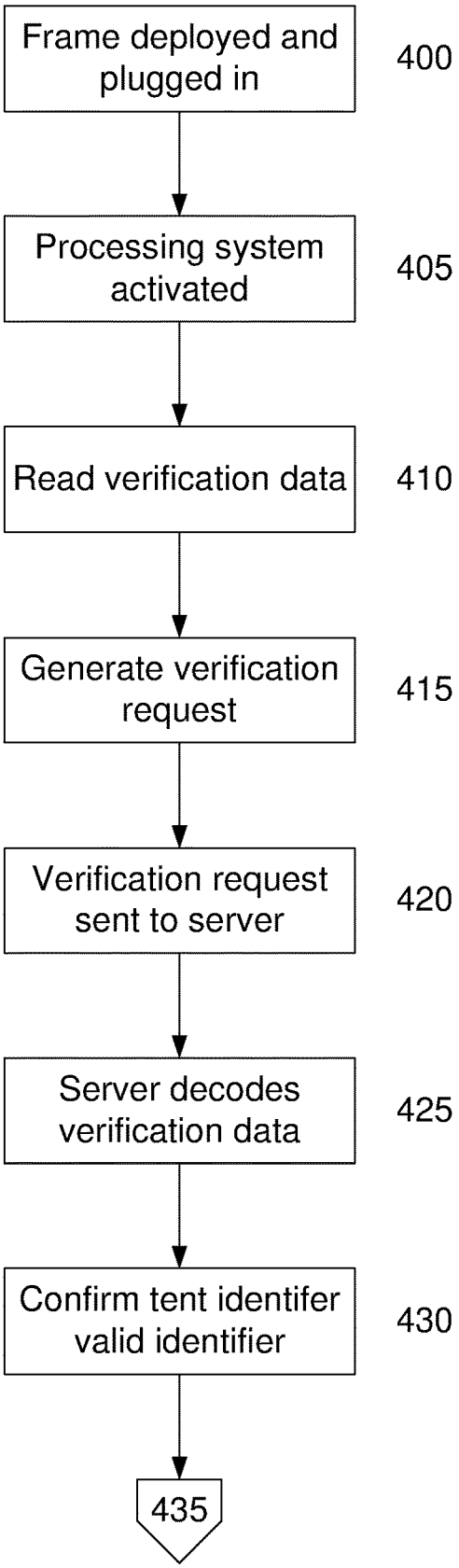
FIGS. 4A and 4B are a flow chart of a specific example of an isolation tent verification method using the isolation tent verification system of FIG. 3.
Figure 4B:
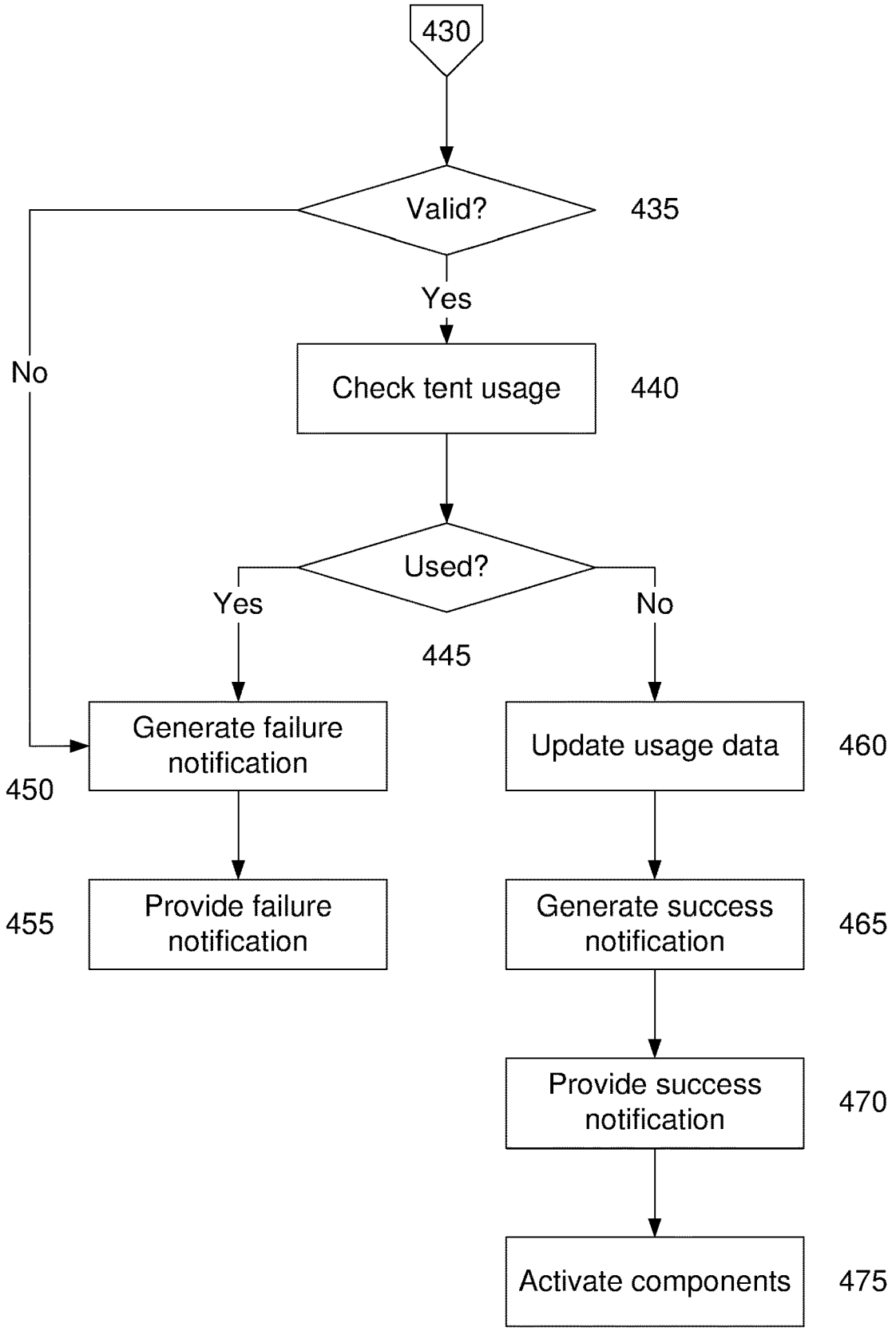

In this example, the processing systems 310 are adapted to retrieve verification data and then communicate with the computer system in order to allow verification to be performed. An example of this will now be described in further detail with respect to FIGS. 4A and 4B.

For the purpose of these examples it is assumed that the computer system 330 includes one or more servers that execute software allowing relevant actions to be performed, with actions performed by the server 330 being performed by a respective processor in accordance with instructions stored as applications software in the memory and/or input commands received from a user via the I/O device. It will also be assumed that actions performed by the processing system 310, are performed by the processor 311 in accordance with instructions stored as applications software in the memory 312 and/or input commands received from a user via the I/O device 313.

However, it will be appreciated that the above described configuration assumed for the purpose of the following examples is not essential, and numerous other configurations may be used. It will also be appreciated that the partitioning of functionality between the different processing systems may vary, depending on the particular implementation.

In this example, at step 400, the frame 110 is deployed and plugged in to a power supply. This activates the processing system 310 at step 405, either through the processing system being powered up, or woken from a sleep mode or the like, allowing the processing system 310 to commence reading the verification data stored on the tag 320, at step 410.

In the current example, this typically involves generating a polling message, which causes the tag processor 321 to generate a response including verification data retrieved from the tag memory 322. This is performed in accordance with standard tag reading protocols and will not therefore be described in any further detail. It will also be appreciated that in alternative embodiments, for example where the verification data is printed or otherwise provided on the isolation tent body, alternative reading processes could be used.

The verification data is typically indicative of a tent identifier that is uniquely associated with the isolation tent body, and also typically includes an encrypted message, encrypted using a key associated with the server 330. In one example, the encrypted information is a signature created using a secret key of a public/private key pair of the server 330, and can be created using predetermined information and the isolation tent identifier, thereby ensuring the encrypted information is unique for each isolation tent body. It will be appreciated that the verification data is created during manufacture of the isolation tent body, and stored on the tag prior to isolation tent body being shipped for distribution to the end user.

At step 415, the processing system 310 generates a verification request, which is transferred to the server 330 at step 420. The verification request can be of any appropriate form and can include the retrieved verification data, together with other relevant information, such as an identifier of the processing device 310, or the like.

At step 425, the server 330 decodes the verification data, in particular decrypting the encrypted message using the public key of the public/private key pair and determines the isolation tent identifier, confirming that this is a valid identifier at step 430. This will typically involve querying data stored in a secure database which include a list of isolation tent identifiers that have been created and allocated to isolation tents.

Assuming the verification data is successfully decrypted and the isolation tent identifier is determined to be legitimate, it is assumed the isolation tent is a valid isolation tent at step 435, allowing the server 330 to continue to check the isolation tent usage at step 440. In particular this involves querying usage data which identifies the isolation tent identifier of isolation tents that have been previously used, allowing the server 330 to check if the isolation tent has been used at step 445.

If it is determined either that the isolation tent is not valid, or the isolation tent has been used at step 445, then the process moves on to step 450, with the server 330 generating a failure notification at step 450. The failure notification can then be provided to the processing system 310, alerting the processing system that components are not to be activated, or to third parties, notifying them of an attempt to use an invalid or previously used isolation tent. The notification may also be provided to a supplier, alerting them that attempts are being made to use an invalid tent or reuse a valid tent.

Otherwise, the usage data is updated at step 460, to prevent the isolation tent being reused, before a success notification is generated at step 465, and provided to the processing system 310 at step 470, allowing the processing system to activate components, such as an air filter, door actuator, lighting, or the like at step 475.

Accordingly, it will be appreciated that this provides a remote verification process, which can assist in ensuring security of the verification process. Additionally, as this automatically tracks usage of the isolation tents, this can be integrated into a supply system, allowing replacement tents to be supplied automatically as tents are used.

Figure 5A:
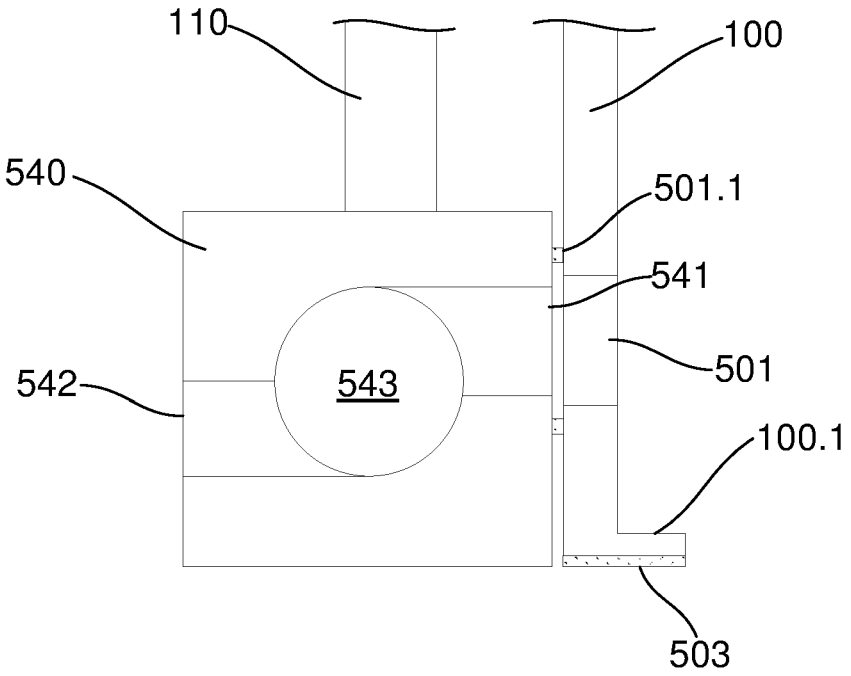
FIG. 5A is a schematic side view of an example of an air filtration system incorporating an isolation tent filter.
Figure 5B:
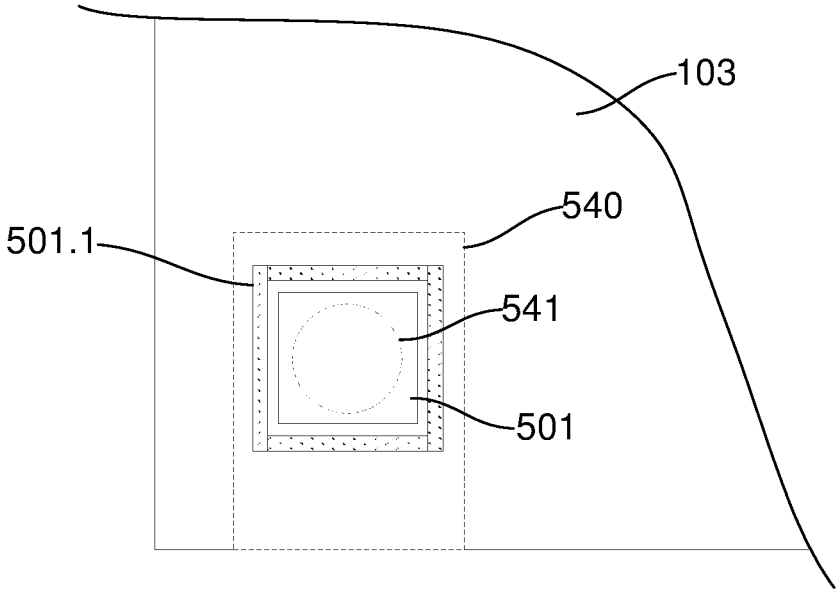
FIG. 5B is a schematic close up front view of plan view of the air filtration system of FIG. 5A.

A third aspect of the invention involving the use of an integrated air filter member will now be described with reference to FIGS. 5A and 5B.

In this example, the isolation tent body 100, includes a filter member 501 that filters air flowing into or out of the internal volume. The filter member 501 can be in the form of a charcoal filter, a carbon filter, a particulate filter, a HEPA (High-Efficiency Particulate Arrestance) or other similar filter, and can be provided in a wall and/or roof of the isolation tent.

Providing the filter member in the isolation tent body provides a number of advantages, and in particular ensures a fresh filter is provided each time a subject is to be isolated, thereby ensuring adequate air filtering is performed, and preventing cross-contamination of subjects.

A number of further features associated with the third aspect of the invention will now be described.

In one example, the filter member can be adapted to be used in conjunction with an air filter unit 540, to allow forced air filtration. In this example, the filtration system 540 includes an inlet 541 and outlet 542, connected via a pump or fan 543, allowing air to be drawn in through the inlet and expelled through the outlet. The filter unit 540 is typically mounted to the frame 110 so that the inlet 541 is positioned adjacent the filter member 501 so as to extract air from the internal volume, through the filter member 501. In one example, the isolation tent body 100 can be adapted to sealingly engage the air filtration system, for example by having an adhesive 501.1, such as double sided tape, extending at least is part way round the filter member 501 to thereby attach the body to the air filtration system. Alternatively at least partial sealing could be achieved in other ways, such as through use of a magnetic coupling or the like. For example, the filter member could include a ferromagnetic perimeter, which engages with magnets in the air filtration system, to thereby hold the filter member in alignment with the air filter inlet. Additionally and/or alternatively a rubber seal can be provided to seal the filter and/or hold the filter in place.

In one example, the body 100 may also include a flap 100.1 which engages a surface supporting the apparatus using an at least partially adhesive material 503 provided on a lower edge of the walls, to thereby at least partially seal the walls to the floor. This can be used to at least partially seal the internal volume, and help ensure airflow out of the volume is through the filter member, allowing contaminants from within the internal volume to be removed before air is expelled into the surrounding area. The adhesive material can be of any suitable form, and could include an adhesive tape or other similar material attached to or otherwise integrated into the isolation tent body.

The above described isolation tent body is typically provided in a packaging having an opening, and with the body being folded within the packaging so that the connectors are accessible without unfolding the body and/or removing the body from the packaging. This leads to a fourth aspect of the invention, which involves attaching the isolation tent body to a frame.

In this aspect, the method of attaching the isolation tent body to a frame involves accessing from a packaging containing the body, a plurality of connectors, the connectors being accessible without unfolding or removing the body from the packaging. Following this the connectors are attached to a frame in a collapsed position, before extending the frame, with the body unfolding as the frame is extended. Thus, the isolation tent is supplied in a packaging that allows this to be easily connected to the frame, whilst the frame is an at least partially retracted configuration, with the isolation tent body then deploying as the frame is erected.

As part of this, the body can be provided in an outer package that needs to be removed, before the connectors can be accessed, whilst the tent body remains contained within an inner packaging. This can help ensure sterility, whilst avoiding the connectors catching or snagging during transport or storage.

The packaging could be removed prior to erecting the frame, or could be removed as part of an action of unfolding the body as the frame is erected.

The packaging remains attached to the body and is adapted to act as a refuse receptacle, for example this could provide a bag or other similar configuration into which the tent body can be stowed following use, allowing this to be more easily disposed of.

As part of this, the isolation tent body can include curtains defining a door, wherein the curtains are attached to the body in an open position, and are detachable to allow the curtains to be attached to a door mechanism mounted to the frame. In this example, this can facilitate erection of the isolation apparatus, specifically allowing the isolation tent to be more easily extended over the patient, bed or other items, if the isolation apparatus is erected in situ.

In order to achieve this mode of operation, the body needs to be packed in packaging in a particular way in accordance with a fifth aspect of the invention.

In this example, the method includes packing a body within packaging by folding first opposing sides, with each side corresponding to one or more side walls, along an upright mid line so that second opposing sides are brought into proximity and then in either order, concertinaing the second opposing sides or folding the body lengthwise.

Utilising this packing method ensures that the connectors are provided along one side of the body and can be directly attached to the frame, with the frame being subsequently extended so that the isolation tent body unfolds.

A number of further features of the fifth aspect of the invention will now be described.

The method typically further includes concertinaing the second opposing sides using an odd number of folds, and in one example using seven folds, although it will be appreciated that even numbers of folds could be used in some examples. More specifically the method typically includes folding opposing front and back sides to bring these sides together and concertinaing the sides. By doing this, opposing front and back walls are folded to bring front corners together and back corners together, with the side walls being concertinaed, and then folding over a front left corner and back left corner to bring left corners together and right corners together.

A specific example of the folding process will now be described with reference to FIGS. 10A to 10E.

In this example, a first step of the folding process involves folding the front and back walls 101, 102 inwardly along a midline, with the roof 104 being pulled inwardly and downwardly allowing the side walls 103 to be brought together. In this example connectors for the front right, front left, back right, and back left corners are labelled 120.1, 120.2, 120.3, and 120.4 respectively, to facilitate understanding of the folding process.

Figure 10A:
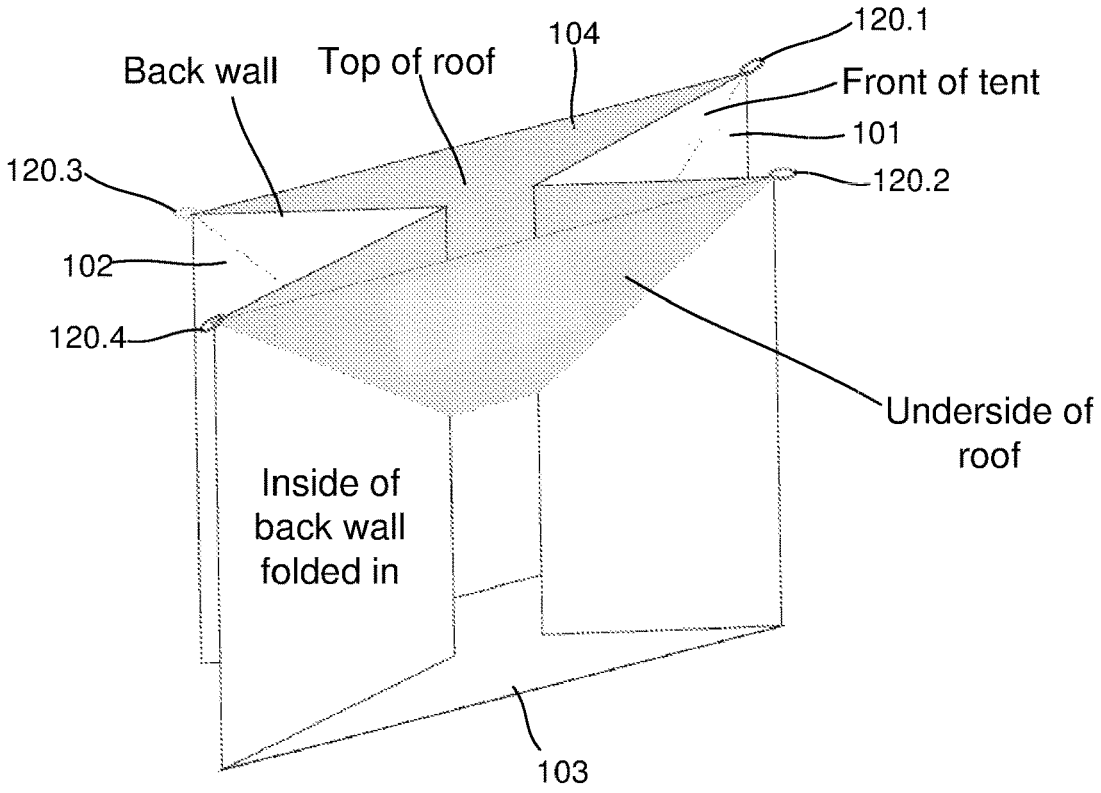
FIG. 10A is a schematic diagram of an example of a first step in a method of packing an isolation tent.
Figure 10B:
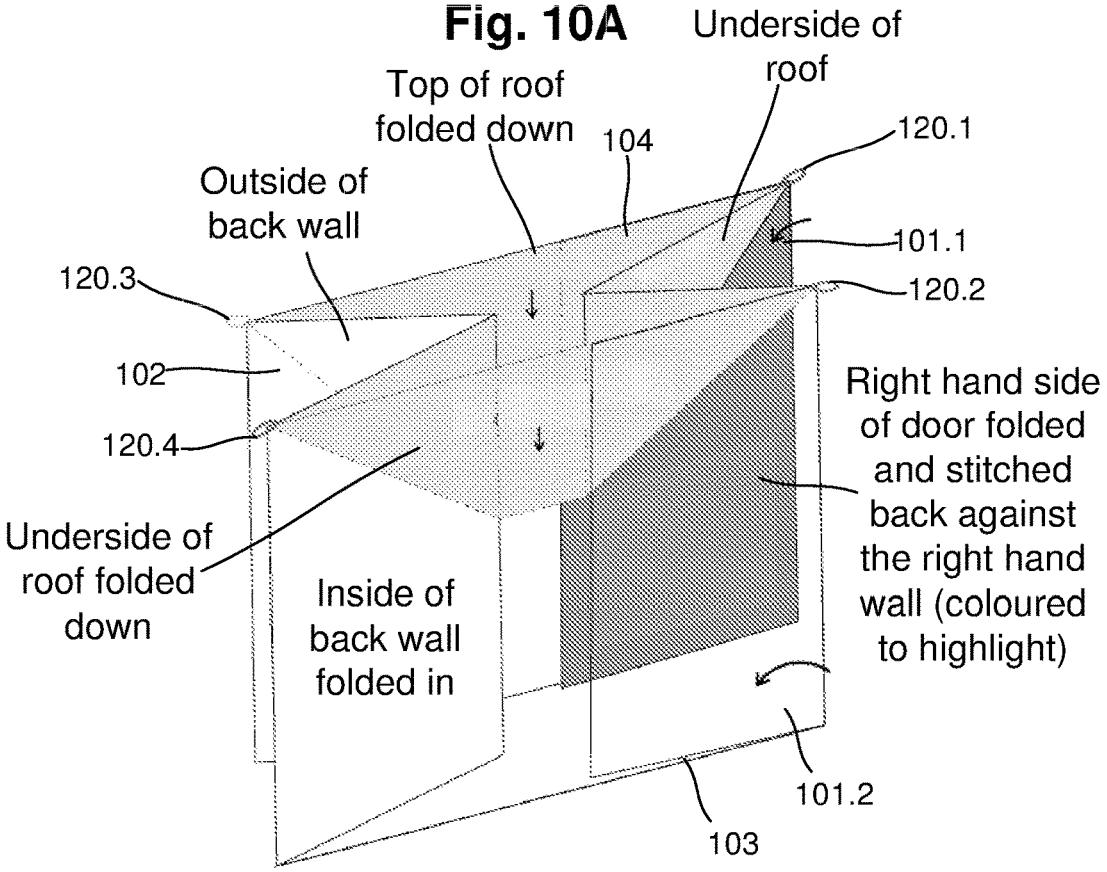
FIG. 10B is a schematic diagram of an alternative example of a first step in a method of packing an isolation tent.

In the example of FIG. 10B, doors 101.1, 101.2 are folded open and attached to inner surfaces of the respective side walls 103, so that the doors remain open during deployment of the isolation tent.

Figure 10C:
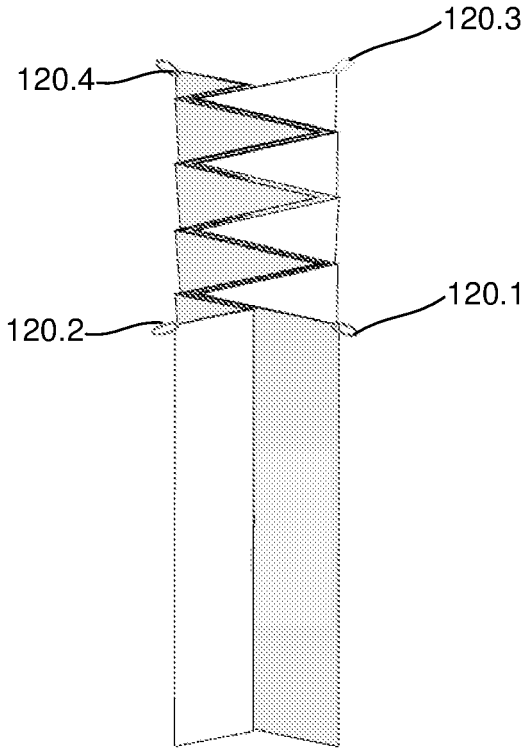
FIG. 10C is a schematic diagram of an example of a second step in a method of packing an isolation tent.
Figure 10D:
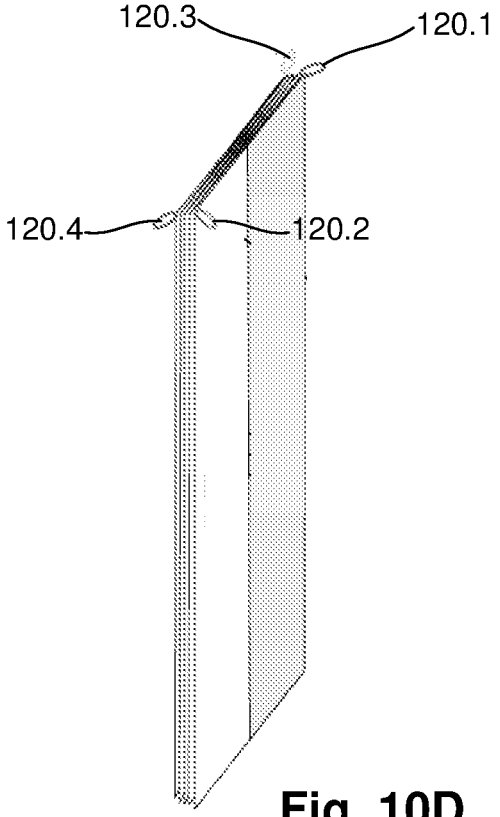
FIG. 10D is a schematic diagram of an example of a third step in a method of packing an isolation tent.
Figure 10E:
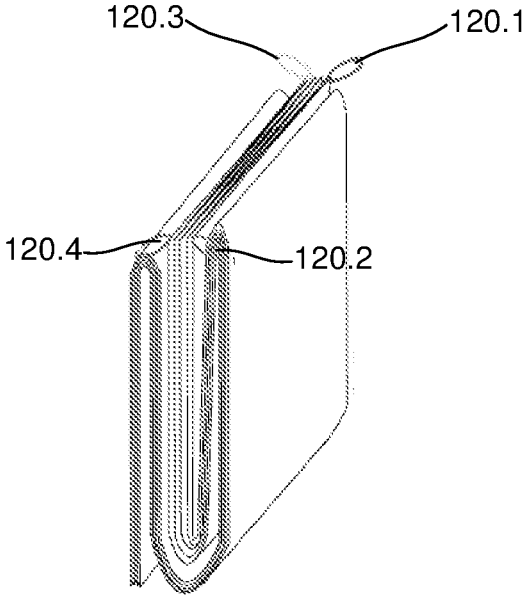
FIG. 10E is a schematic diagram of an example of a fourth step in a method of packing an isolation tent.

In a second step, shown in FIG. 10C, the tent body is concertinaed by folding the side walls seven times, with the front and rear left corners 120.2, 120.4 being folded over so that the front and rear left corners 120.2, 120.4 are bought together and the front and rear right corners 120.1, 120.3 are bought together, as shown in FIG. 10D. Finally, the tent body is folded heightwise as shown in FIG. 10E.

It will be appreciated that this folds the tent body so it can be packed, with the connectors 122 accessible and able to be connected to the frame prior to frame deployment, so that the tent body can be unfolded as the frame is erected. It will also be appreciated that the steps of FIGS. 10E and 10C could be interchanged, so the tent body is folded heightwise before being concertinaed, whilst still allowing the same outcome to be achieved.

It will be appreciated from the above that a range of different connector configurations could be used. In one alternative example, the frame connector includes a channel in the frame, and the connector includes a slotted peg slidably mounted within the channel. The frame includes multiple channels and each channel includes an opening shaped to receive a respective slotted peg, thereby allowing pegs to be slidably mounted within respective channels. The channel includes a releasable lock used to selectively lock the peg within the channel. A specific example of such a configuration will now be described with reference to FIGS. 11A to 11G.

In this example, the isolation tent 1100 includes side walls 1102 and a roof 1104, joined at respective seams, with a rim 1106 typically extending outwardly from the seams, and one or more mounting tabs 1105 extending outwardly from the rim adjacent each corner, allowing attachment cords 1122.1 to be attached thereto. The attachment cords 1122.1 are attached to a connector 1122, in the form of a slotted peg 1122.2. The slotted peg 1122.2 is typically elongate and includes a circumferential slot 1122.4 having contact plates 1122.3 on either end, allowing the peg to be provided within a channel 1121.2 provided on an upper end of the frame legs 1111, with flanged edges of the channel 1121.2 being provided within the slot, to thereby allow the peg 1122.2 to be slidably mounted within the channel 1121.2.

Figure 11A:
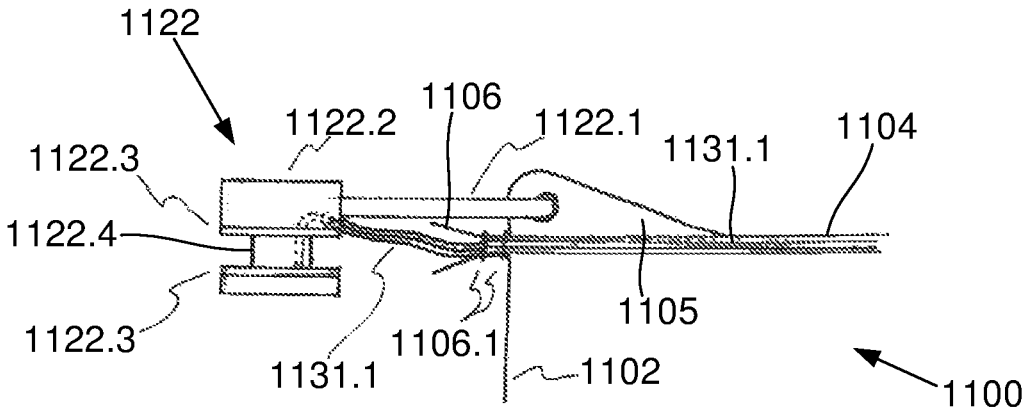
FIG. 11A is a schematic side view of a further example of a connector.
Figure 11B:
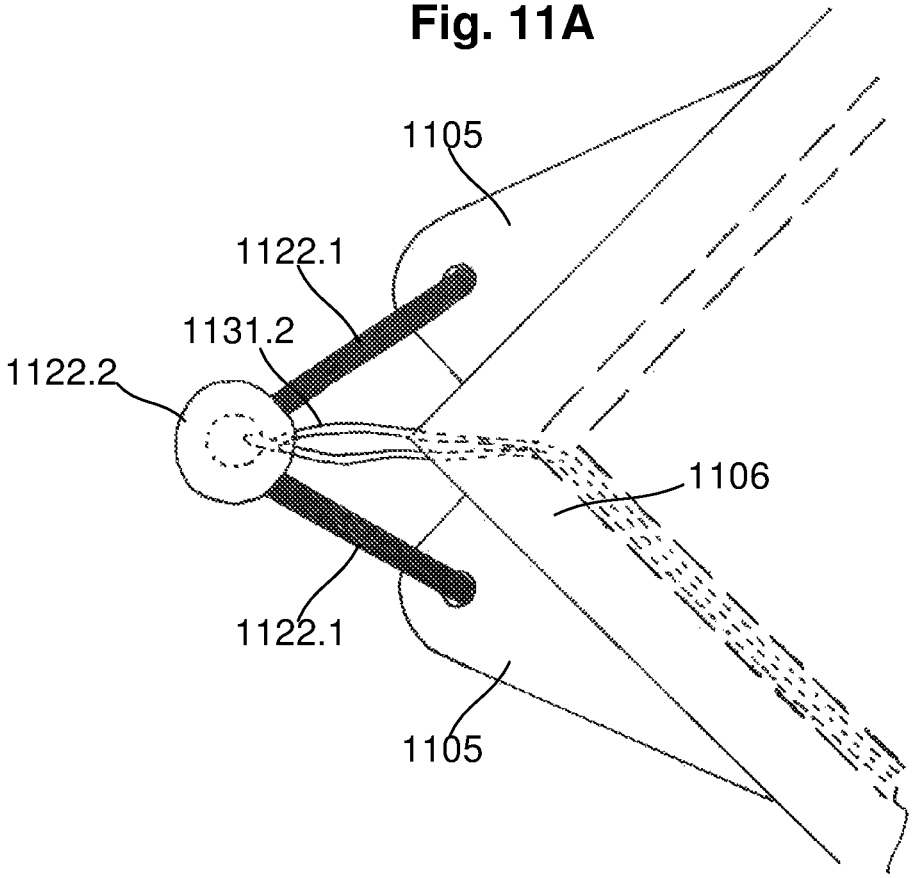
FIG. 11B is a schematic plan view of the connector of FIG. 11A.
Figure 11C:
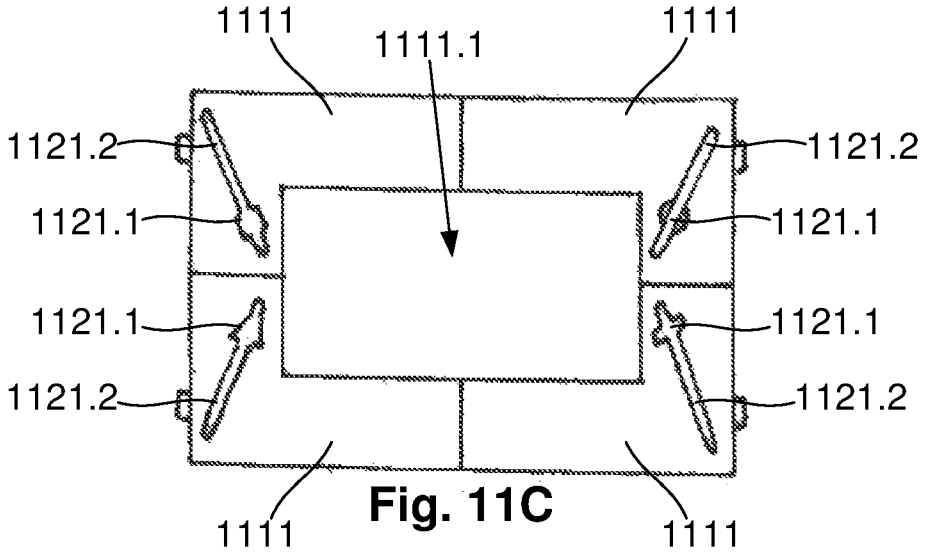
FIG. 11C is a schematic plan view of a first stage in attaching an isolation tent to a frame using the connector of FIG. 11A.
Figure 11D:
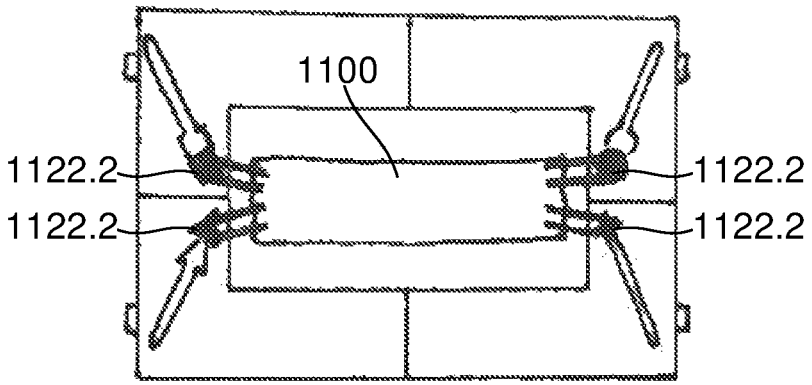
FIG. 11D is a schematic plan view of a second stage in attaching an isolation tent to a frame using the connector of FIG. 11A.
Figure 11E:
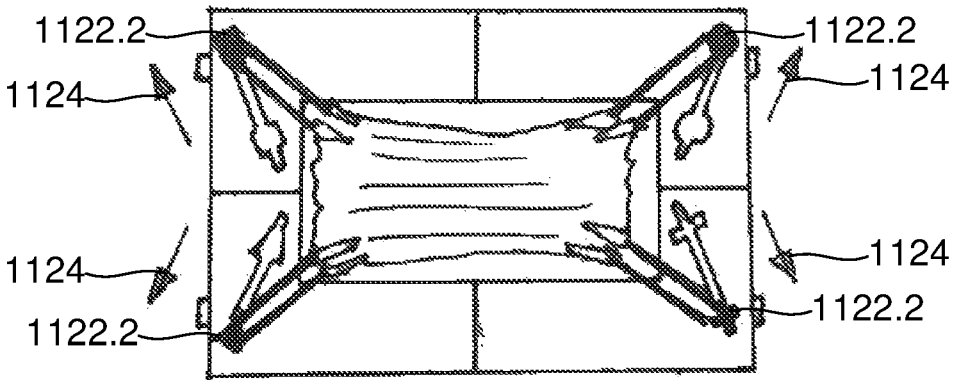
FIG. 11E is a schematic plan view of a third stage in attaching an isolation tent to a frame using the connector of FIG. 11A.

In the example shown in FIGS. 11A and 11B, the slotted peg 122.2 has a circular cross-sectional shape, allowing this to be inserted into the channel 1121.2 via a complementary shaped channel opening 1121.1. However, as shown in FIGS. 11C to 11G, each channel can have a respective shaped opening, allowing different connectors 1122 of the isolation tent to be selectively attached to the frame, thereby ensuring the isolation tent is in the correct orientation.

In this regard, as shown in FIGS. 11C to 11F, the frame is initially provided in a collapsed configuration, with the legs 1111 provided in abutment, so as to define an open region 1111.1 into which the isolation tent 1100 can be placed. In this regard, the isolation tent is initially provided in packaging, with the connectors 1122.2 exposed, allowing each of these to be inserted into a respective opening 1121.1 having a corresponding shape.

Following this, the connectors 1122.2 can be moved outwardly along the channels 1121.1 as shown by the arrows 1124, to ends of the channels 1121.2, where the connectors are locked in position by a locking mechanism. This action tensions the attachment cords 1122.1, tensioning the isolation tent and in one example, causing the packaging to be spilt open, thereby releasing the isolation tent 1100.

Figure 11F:
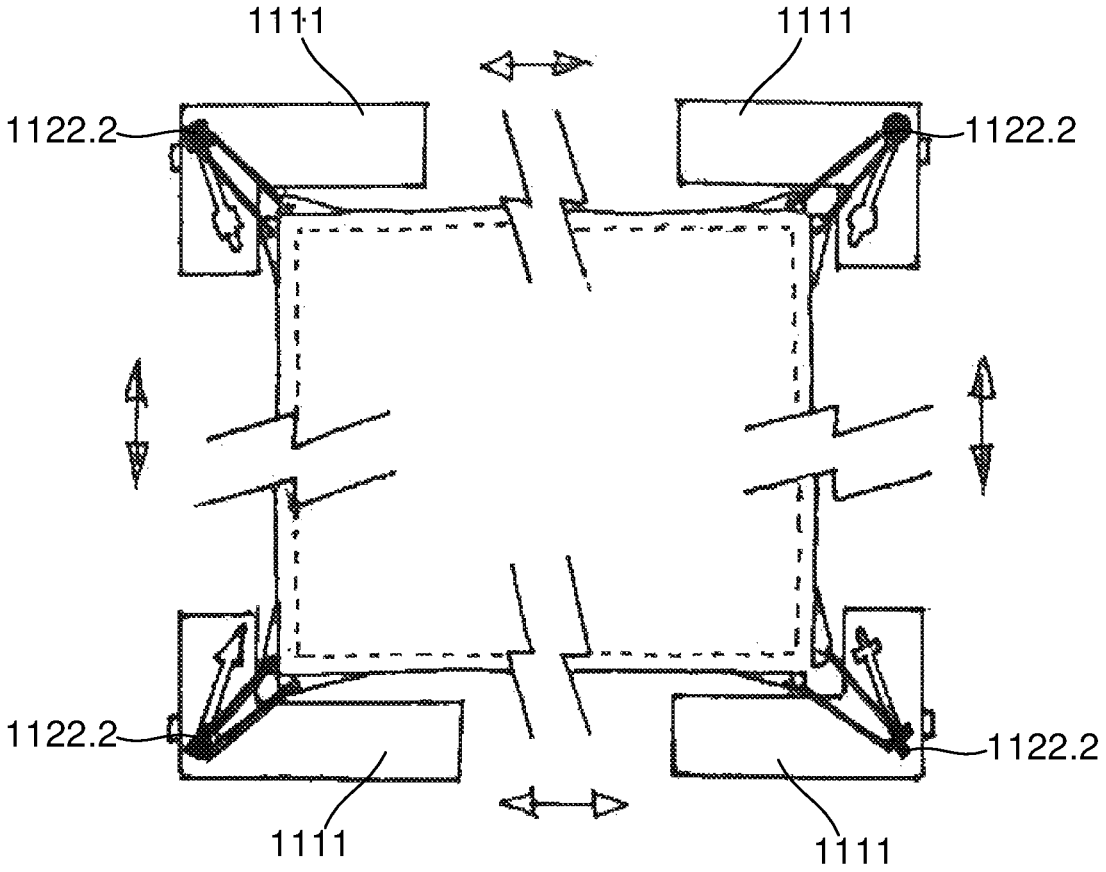
FIG. 11F is a schematic plan view of a fourth stage in attaching an isolation tent to a frame using the connector of FIG. 11A.
Figure 11G:
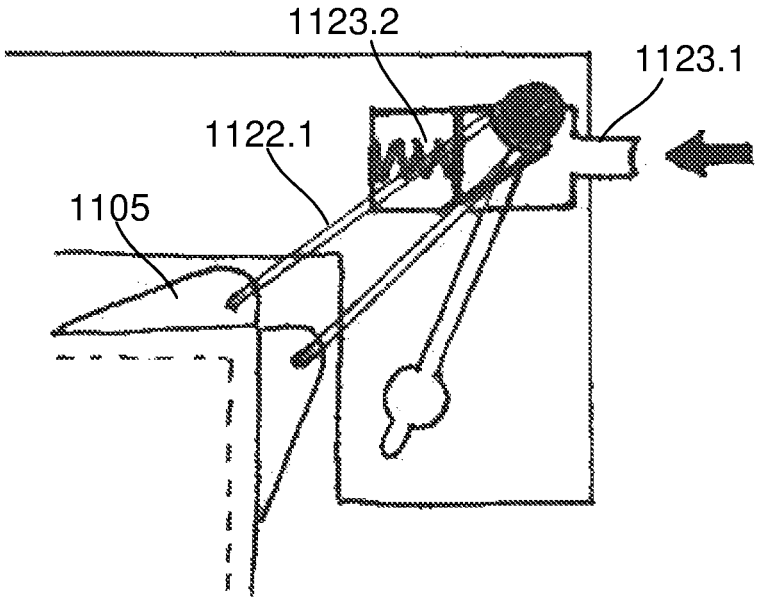
FIG. 11G is a schematic plan view of a release mechanism for releasing an isolation tent to a frame using the connector of FIG. 11A.

The frame can then be erected, with the action opening the isolation tent as shown in FIG. 11F.

When the isolation tent has been used, this can be removed from the frame by pressing a release button coupled to an actuator 1123.1, which is biased by a spring 1123.2, and which engages the connector 1122.2. As the actuator is depressed, this releases the connector 1122.2, allowing this to slide along the channel 1121.2 to the opening 1121.1, so that the connector 1122.2 and hence the isolation tent can be removed from the frame.

Finally, the connector 1122.2 also typically includes wires 1131.1, extending through the rim 1106, and along the seam, to allow connection to one or more electrical components, for example as previously described. In this example, the wires 1131.1 can be attached to the rim 1106 via stitching 1106.1 to thereby hold the wires 1131.1 in position and prevent these being damaged or pulled from the tent in use.

Further example arrangements in which a filter member is provided including a connector will now be described with reference to FIGS. 12A to 12F and 13A and 13B.

In this example, the isolation tent 1200 includes a filter member 1250, mounted in a rear wall 1202 of the filter member, with the tent also typically including front and side walls 1201, 1203, a roof 1204, and doors 1242.

The filter member 1250 includes a connector that is adapted to physically attach the filter member to the frame 1310 and in one example to an air filtration system 1305 coupled to the frame 1310. The frame 1310 is of a form generally similar to that described previously and includes upright legs 1311, interconnected by scissor arms, having connectors 1322 that support the tent.

It will be appreciated that the air filtration system 1305 can be similar to that described above with reference to FIGS. 5A and 5B, and typically includes an inlet and outlet, connected via a pump or fan 1305.1, allowing air to be drawn in through the inlet and expelled through the outlet. The filter member 1250 can include a charcoal filter, a carbon filter, a particulate filter, a HEPA (High-Efficiency Particulate Arrestance) or other similar filter to filter air extracted from the internal volume within the tent.

In the current example, the filter member includes a filter frame 1251 supporting a filter body 1252. In this case, the connector is formed by the filter frame 1251, which engages a filter mounting 1205 on the frame to thereby attach the filter member to the frame. The filter mounting 1205 is typically provided as part of the filtration system, so that the filter member sealingly engages with the filter mounting, allowing the filtration system to extract air from the internal volume, through the filter member 1250. The filter mounting 1205 and filter frame 1251 can be coupled using any suitable coupling mechanism, such as a friction fit, hook and eye, interference fit, clip, fit or the like.

In the current arrangement, the apparatus includes an electrical component electrically connected to the connector to allow electrical signals to be transferred to or from the electrical component via the connector. In particular, in this example, the filter member includes first and second filter member contacts 1253 mounted on the filter frame 1251 and electrically connected to the electrical component. The filter member contacts 1253 engage corresponding frame contacts 1206 attached to the filter mounting 1205. In this case, this allows signals to be transferred between the tent 1200 and the frame. In particular, the frame contacts 1206 are typically electrically connected to electrical equipment, such as the filtration unit or door actuator, to thereby electrically connect the electrical component to the electrical equipment.

For example, the electrical component can include a conductor 1255 extending between the first and second filter member contacts 1253, allowing signals to be transferred via the tent. This could be in the form of a metallic "electrical jumper", PCB, or other electrical connector, which is optionally moulded into the filter frame 1251 and can be used to complete a circuit, for example to allow power to be supplied to equipment in the frame. For example, the frame contacts could be coupled to a power supply 1305.2 and the filtration unit 1305, so that power is only supplied to the filtration unit, when the filter member 1250 is correctly installed. This prevents operation of the filtration unit in the event that the apparatus is used with a tent that does not include the correct filter member, or if the filter member is not installed correctly. This can help ensure that isolation is maintained, by effectively providing a notification through failure of the filtration unit, if the tent is not a legitimate tent, or is not correctly installed.

The electrical component could also include an optional identification tag 1256 for performing additional verification, for example in a manner similar to that previously described.

In one embodiment the filter member contacts 1253 are mounted in respective recesses 1254 in the filter frame. This can be used to facilitate engagement with the frame contacts 1206, or can be used to allow a secondary filter member 1260, to be coupled thereto. In this example, the secondary filter member 1260 can include having a frame 1261 and body 1262, as well secondary filter contacts 1263, which engage the filter contacts 1253, allowing further electrical connections and pathways to be created.

It will be noted that in the examples of FIGS. 12A to 12F, the electrical contacts are shown in the top and bottom of the filter member 1250, although this is not essential, and alternatively contacts could be provided in the top or bottom only, or in other parts of the filter, such as the sides, a face of the frame, or the like.

Figure 13A:
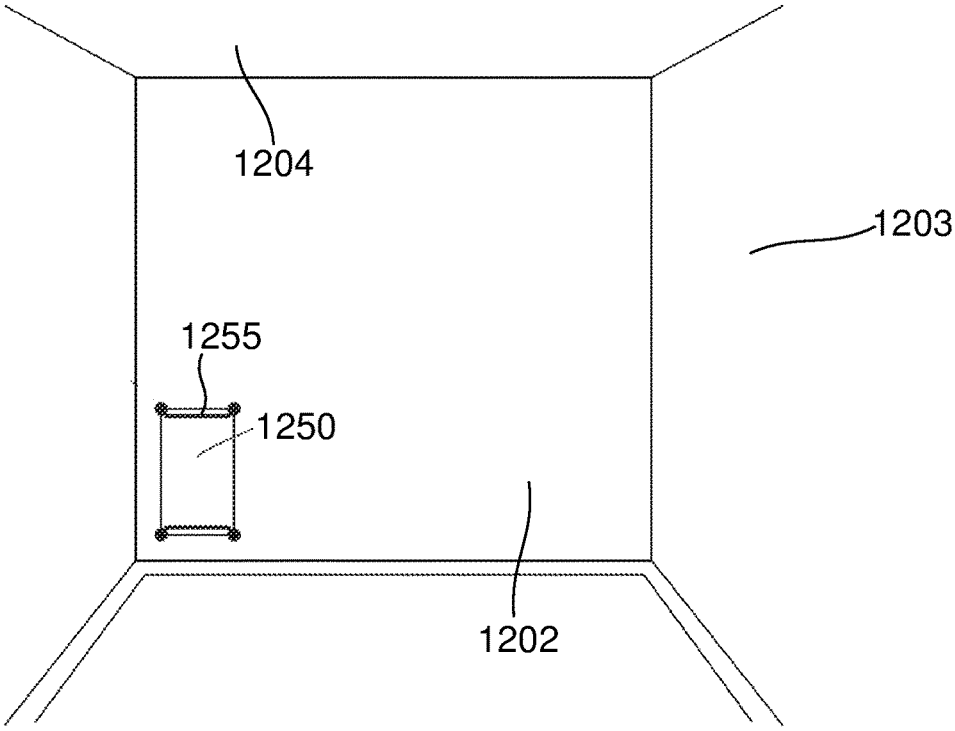
FIG. 13A is a schematic front view of an example of an isolation tent including a filter member with first example electrical connections.
Figure 13B:
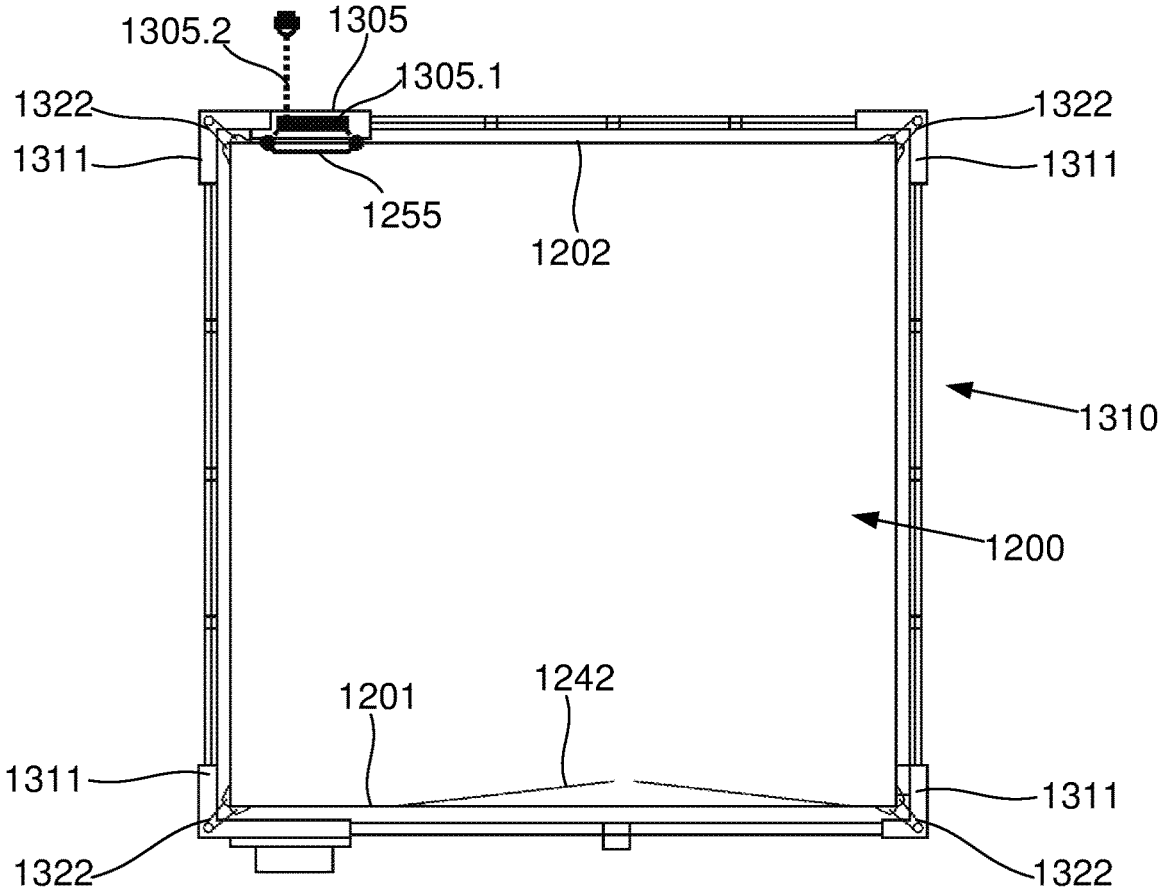
FIG. 13B is a schematic plan view of the isolation tent of FIG. 13A.

In the example of FIGS. 13A and 13B, the filter member 1250 is only used to transfer power from the supply 1305.2 to the filtration unit 1305. However, it will be appreciated that other arrangements can be used.

Figure 14A:
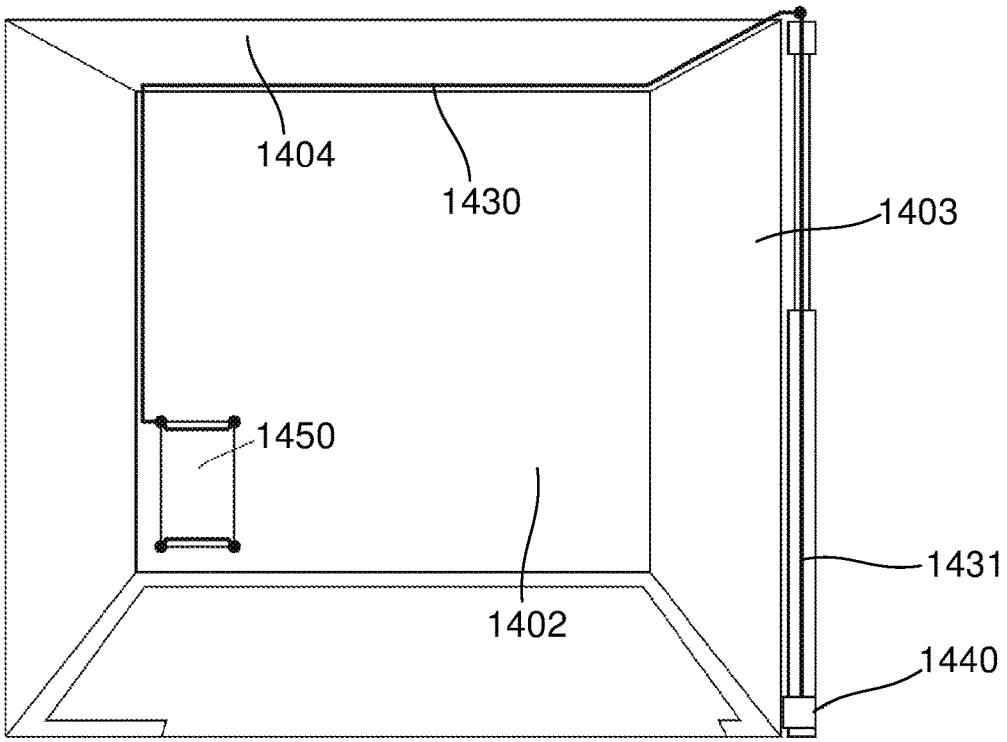
FIG. 14A is a schematic front view of an example of an isolation tent including a filter member with second example electrical connections.
Figure 14B:
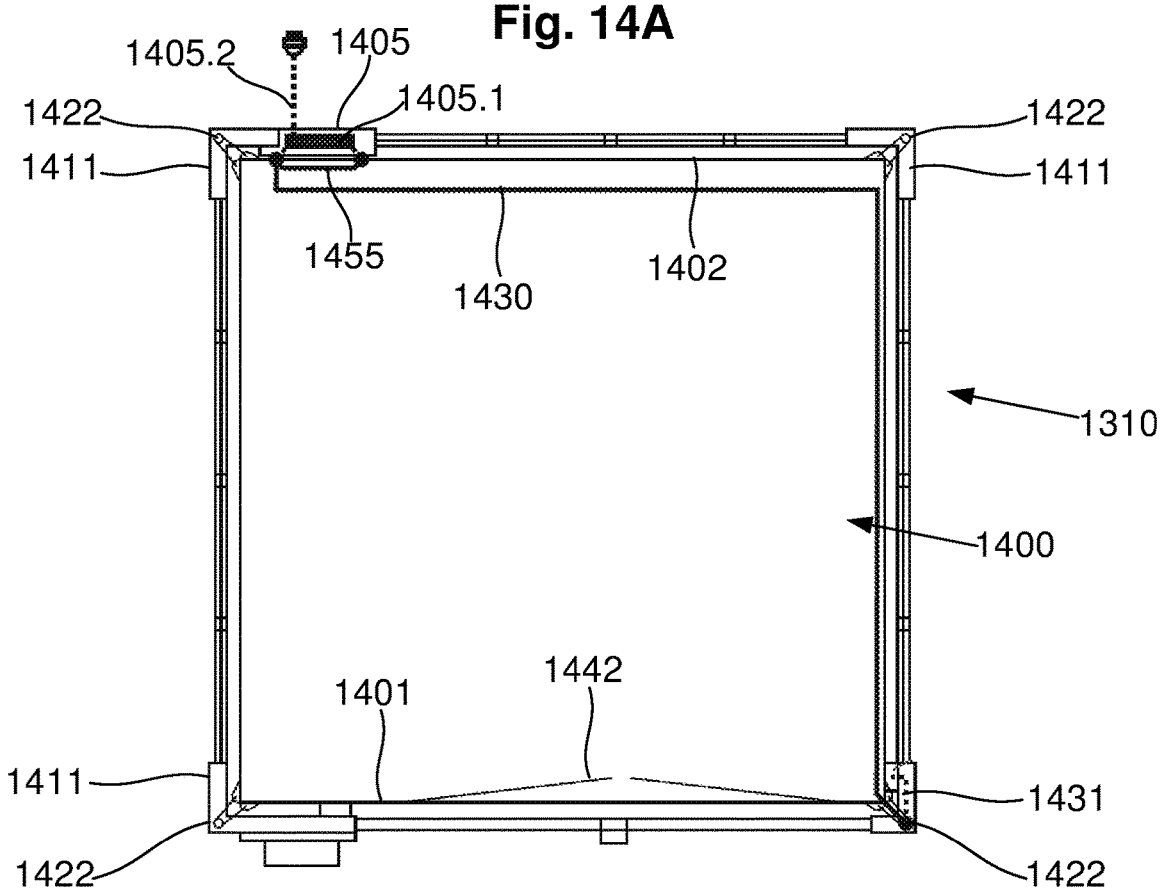
FIG. 14B is a schematic plan view of the isolation tent of FIG. 14A.

A further example will now be described with reference to FIGS. 14A and 14B, in which reference numerals are increased by 200 and 100 compared to the features of FIGS. 12A to 12F and 13A and 13B, respectively.

In this example, the isolation tent 1400 includes a filter member 1450, mounted in a rear wall 1402 of the filter member, with the tent also typically including front and side walls 1401, 1403, a roof 1404 and doors 1442. The filter member 1450 includes a conductor 1455 for providing an electrical connection and thereby supply power to a filtration system 1405 mounted to the frame 1410. The frame includes upright legs 1411, interconnected by scissor arms, and having connectors 1422 that support the tent.

In this example, the system further includes a door actuator 1440, in the form of a foot pedal or similar. Power is supplied to the door actuator 1440, via a connection 1431 within the leg 1411, a connector 1422, and a conductor 1430 running through the tent body to the conductor 1455 in the filter member 1450.

Thus, in this example, as well as supplying power to the filtration system, the conductor 1455 in the filter member is also used in conjunction with a conductor 1430 through the tent body to provide power to a door actuator 1440.

Figure 15A:
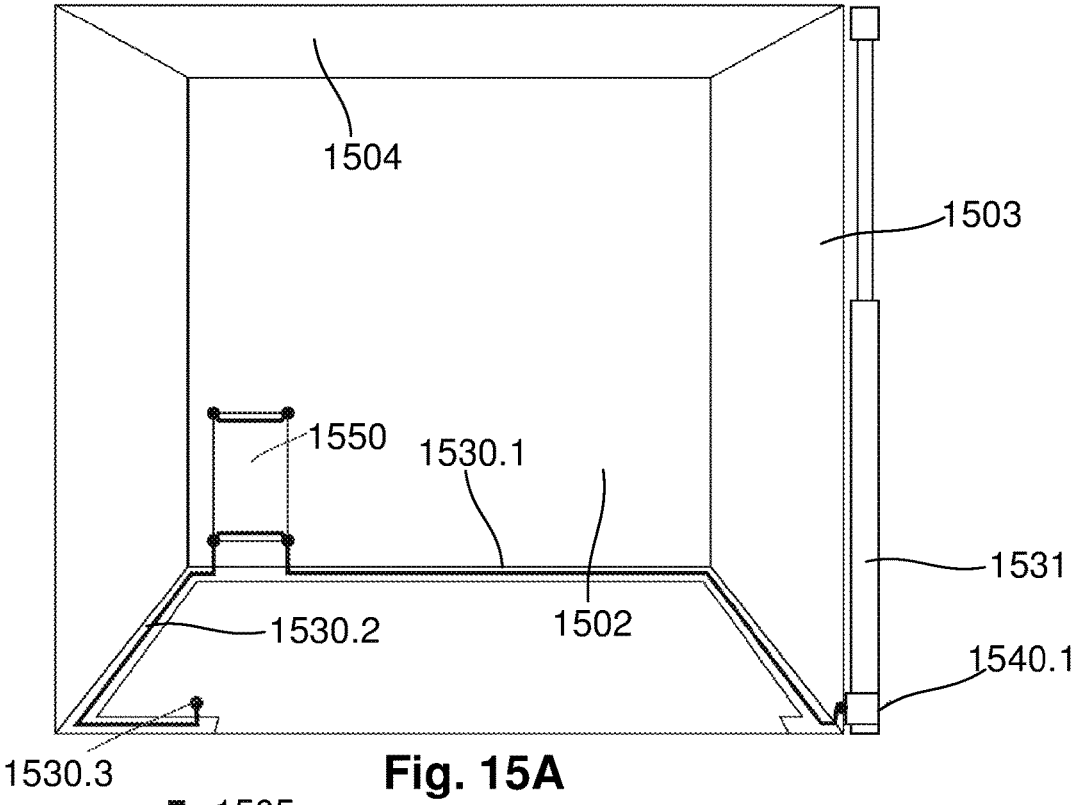
FIG. 15A is a schematic front view of an example of an isolation tent including a filter member with third example electrical connections.
Figure 15B:
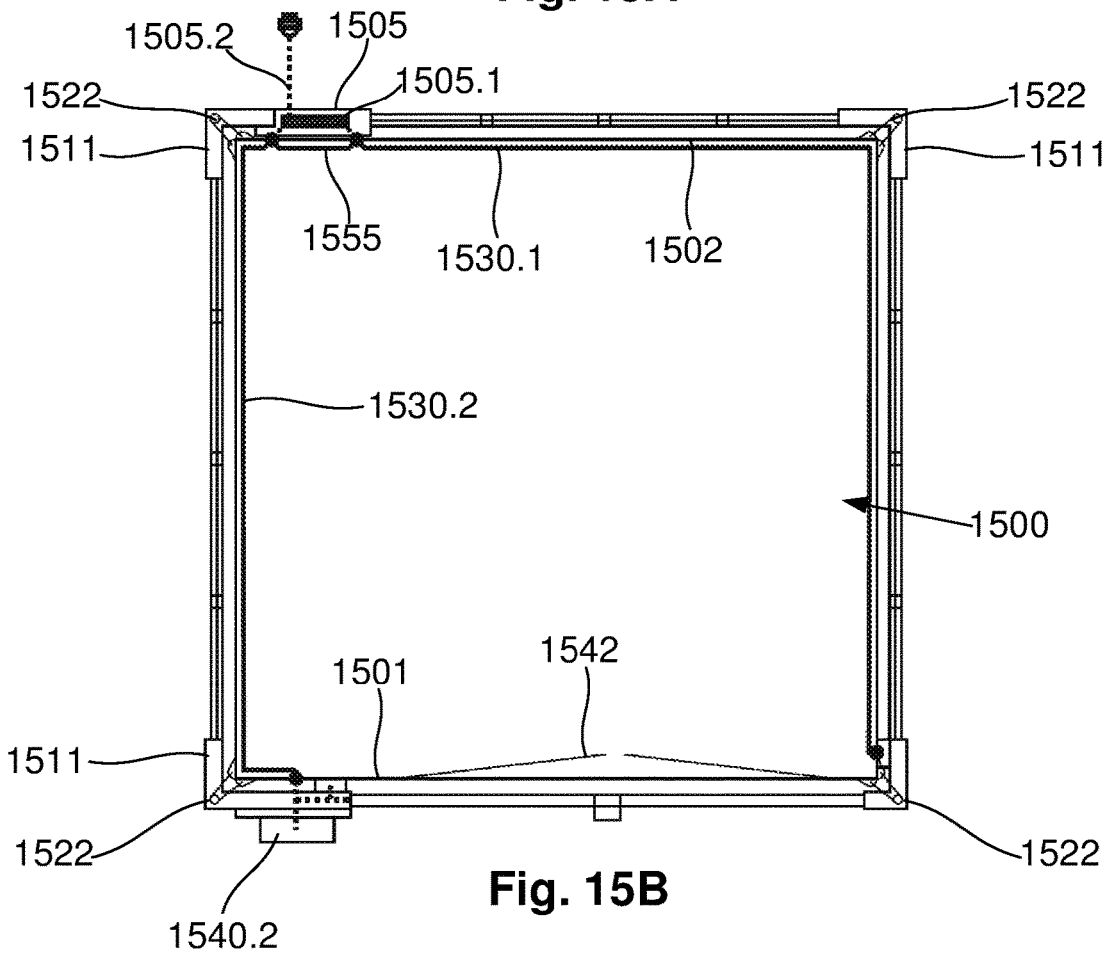
FIG. 15B is a schematic plan view of the isolation tent of FIG. 15A.

A further example will now be described with reference to FIGS. 15A and 15B.

In this example, the isolation tent 1500 includes a filter member 1550, mounted in a rear wall 1502 of the filter member, with the tent also typically including front and side walls 1501, 1503, a roof 1504 and doors 1542. The filter member 1550 includes a conductor 1555 for providing an electrical connection and thereby supply power to a filtration system 1505 mounted to the frame 1510. The frame includes upright legs 1511, interconnected by scissor arms, and having connectors 1522 that support the tent.

In this example, two conductors 1530.1, 1530.2 are provided running through the tent body to conductors 1555 in the filter member. In this instance the conductor 1530.1 is connected to a door actuator 1540.1, whilst the conductor 1530.2 terminates in a connector 1530.3, allowing this to be coupled to a second door actuator 1540.2.

Figure 16A:
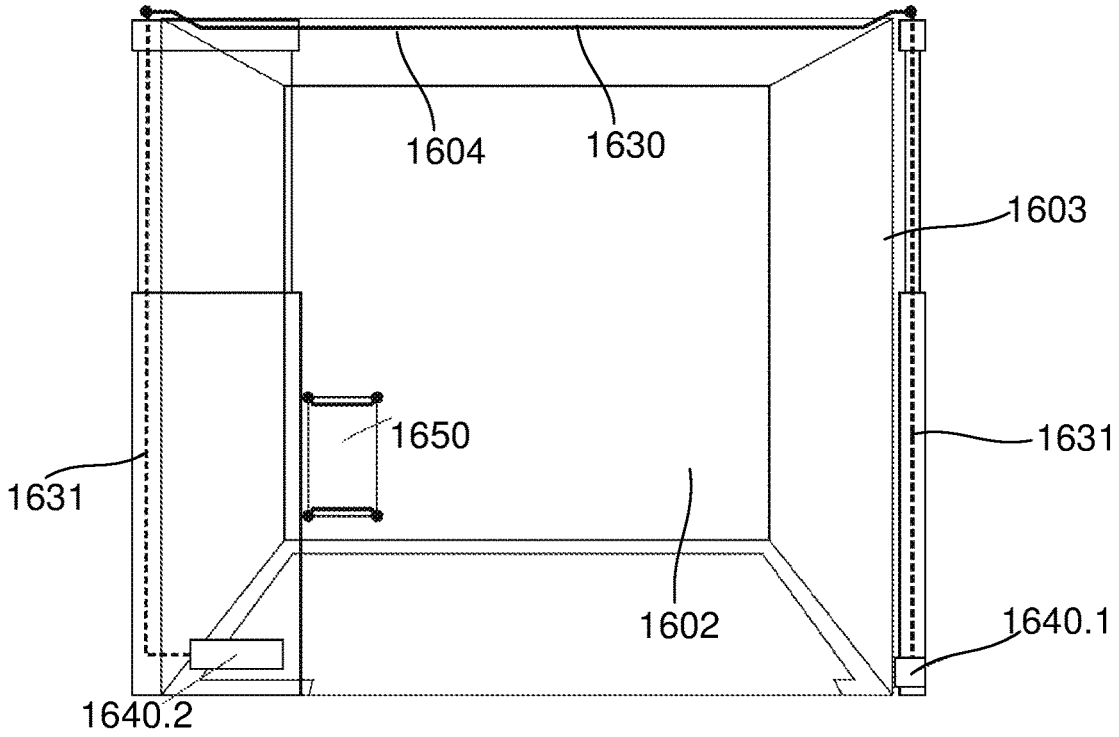
FIG. 16A is a schematic front view of an example of an isolation tent including a filter member with fourth example electrical connections; and, FIG. 16B is a schematic plan view of the isolation tent of FIG. 16A.
Figure 16B:
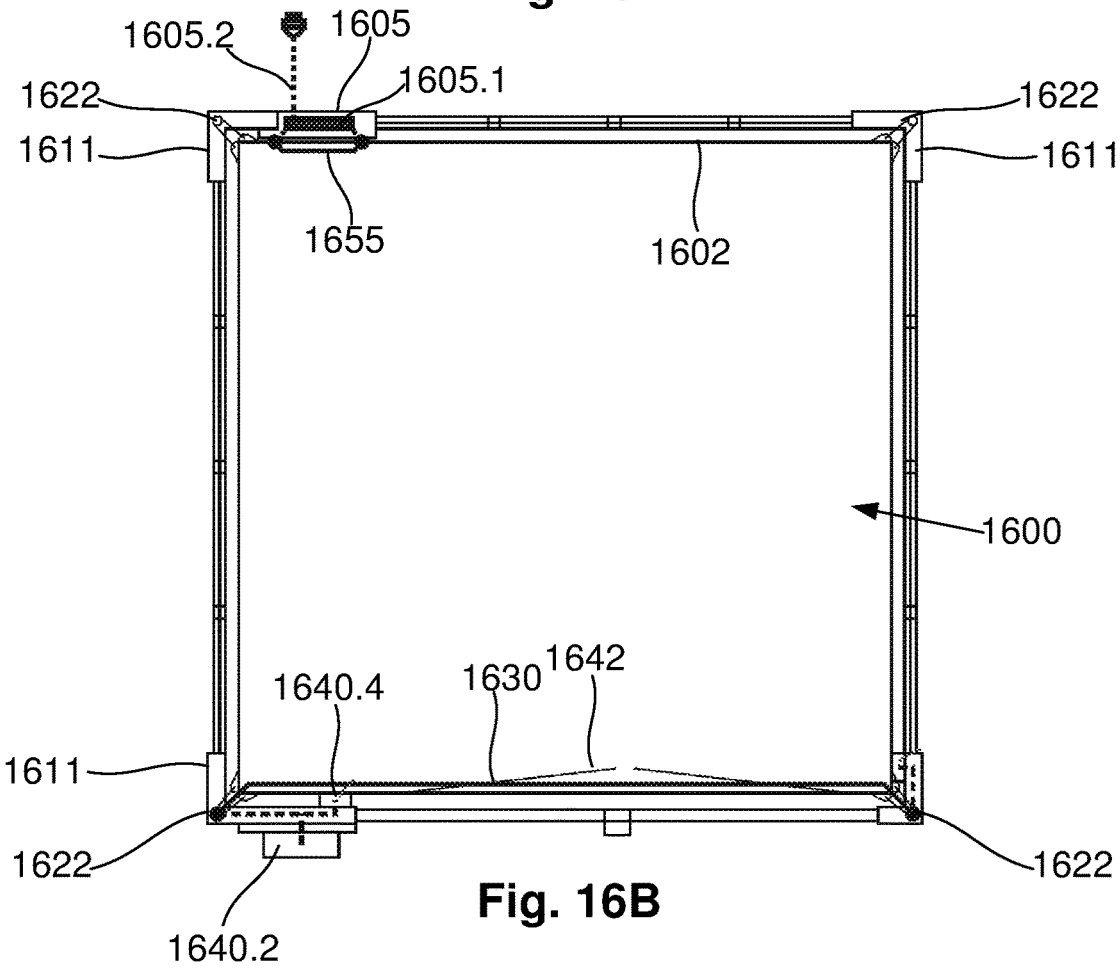

A further example will now be described with reference to FIGS. 16A and 16B.

In this example, the isolation tent 1600 includes a filter member 1650, mounted in a rear wall 1602 of the filter member, with the tent also typically including front and side walls 1601, 1603, a roof 1604 and doors 1642. The filter member 1650 includes a conductor 1655 for providing an electrical connection and thereby supply power to a filtration system 1605 mounted to the frame 1610. The frame includes upright legs 1611, interconnected by scissor arms, and having connectors 1622 that support the tent.

In this example, a conductor 1630 extends across a front of the tent, between respective connectors 1622, allowing first and second door actuators 1640.1, 1640.2 to be electrically interconnected.

Accordingly, in the above examples of FIGS. 12A to 16B, the electrical component and connectors form part of a filter member, with an electrical connection being formed when the filter member is attached to a filtration system integrated into the frame. It will be appreciated that this arrangement can be used in addition to, or alternatively to, the connector arrangements previously described.

Irrespective of the approach used, the above described arrangements provide a tent including some form of electrical component, which in use is electrically connected to equipment via a connector that attaches the tent to the frame in some manner. This can include via connectors that physically couple corners, or other parts of the tent, to a part of the frame, such as the legs of the frame, and/or a connector that is used to connect a filter member to an air filtration system. This allows various functionality to be selectively implemented upon the presence of the electrical component, so that the isolation apparatus will only function upon correct installation of the tent body.

It will be appreciated that the above described features can be implemented independently or in conjunction, for example providing an isolation tent integrating any one or more of electrical components, machine readable verification data, air filters, an integrated door, and the attachment method, or the like.

The above examples have focussed on the provision of an isolation apparatus, which is directed towards providing isolation particularly in respect of touch and droplet types of infection transmission. However, this is not essential and the apparatus can be extended in order to provide protection against airborne transmission, thereby acting an as Airborne Infectious Isolation Room (AIIR).

Whilst the above example has focussed on use of the isolation apparatus in isolating a subject in the form of a patient, it will be appreciated that the above described arrangement can be used whenever any form of isolation is required. For example, the isolation apparatus could be used to isolate equipment, such as a bed, during a decontamination or sterilisation procedure. In this instance, the apparatus is still used in providing isolation, in this case isolating a subject in the form of an object or article, allowing this to be decontaminated, for example through exposure to UV radiation or the like, allowing this to be performed without risk of contamination of the surrounding environment or preventing exposure of the surrounding environment to UV radiation. Thus, if equipment has become contaminated on a ward, the isolation apparatus can be erected around the equipment in situ, and then used to perform a decontamination process, while reducing the chance of contamination of individuals or other equipment on the ward. It will be therefore appreciated that the apparatus can be used in a wide range of circumstances and can be used for isolating any object or article, and that specific reference to patients as a preferred example, is not intended to be limiting.

Whilst the term isolation apparatus is used above, it will be appreciated that this is not intended to be limiting, and is intended to cover arrangements that provide isolation, which is also commonly referred to as barrier precautions in some countries.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers. As used herein and unless otherwise stated, the term "approximately" means ±20%.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. Apparatus for use in providing isolation, the apparatus being adapted to be located on a supporting surface and including an isolation tent having a frame and a body, the body including:

a) a roof member;

b) at least one wall extending between the supporting surface and the roof member in use to thereby at least partially define an internal volume substantially isolated from a surrounding environment;

c) a plurality of body connectors coupled to the body, the plurality of body connectors being adapted to engage the frame; and, d) an electrical component electrically connected to at least one of the plurality of body connectors to allow electrical signals to be transferred to or from the electrical component via the body connector.

2. Apparatus according to claim 1, wherein the body connectors are adapted to at least one of:

a) physically attach the body to the frame; and, b) physically couple to frame connectors of the frame.

3. Apparatus according to claim 2, wherein the body connectors and the frame connectors are mechanically coupled using at least one of:

a) a complementary plug and socket connection;

b) a hook and eye;

c) a friction fit;

d) an interference fit; and, e) a clip fit.

4. Apparatus according to claim 2, wherein the body connector includes a pin and the frame connector includes a socket, wherein the pin is inserted into the socket to couple the frame connector to the frame.

5. Apparatus according to claim 4, wherein the socket includes a catch to secure the pin and a release mechanism to selectively release the pin.

6. Apparatus according to claim 1, wherein the electrical component is at least one conductor extending at least part way across the body, the conductor being electrically connected to at least one of the plurality of body connectors to allow electrical signals to be conducted via the at least one body connector and the at least one conductor.

7. Apparatus according to claim 6, wherein the at least one conductor at least one of:

a) is adapted to conduct at least one of:

i) data communications signals; and, ii) electrical power supply signals;

b) includes at least one of:

i) wires embedded in or attached to the body;

ii) silver plated nylon conductors provided on a surface of the body;

iii) conductive material printed on, sewn to, embedded within or adhered to the body; and, iv) silver plated nanowire conductors provided on a surface of the body; and, c) extends at least partially along a seam between the wall and the roof.

8. Apparatus according to claim 6, wherein at least one of:

a) the body connectors are adapted to electrically couple to frame connectors mounted to the frame, and wherein the frame connectors are electrically connected to respective electrical components; and, b) at least one frame connector is electrically connected to an electrical power supply and at least one frame connector is electrically connected to electrical equipment mounted to the frame so that the electrical equipment can be powered by the electrical power supply via the at least one conductor.

9. Apparatus according to claim 1, wherein the electrical component includes lighting for illuminating the internal volume.

10. Apparatus according to claim 1, wherein the electrical component is used to verify the body and at least one of:

i) the electrical component includes a memory that stores verification data, and wherein the verification data is retrieved by a processing device when the body is connected to the frame, allowing the processing device to verify the body;

ii) the memory is writable allowing the verification data to be updated during use;

iii) verification data is used to verify the body to confirm at least one of:

(1) the body is a correct body for use with a current frame;

(2) the body has not exceeded an expiry date;

(3) the body has not exceeded a shelf life;

(4) the body has not exceeded a defined duration of use; and, (5) the body has not been previously used; and, iv) verification data includes at least one of:

(1) a digital signature;

(2) a unique reference number; and, (3) encrypted data.

11. Apparatus according to claim 1, wherein the body includes a filter member that filters air flowing into or out of the internal volume, wherein the filter member includes a filter connector that is adapted to physically attach the filter member to the frame.

12. Apparatus according to claim 11, wherein the filter member includes a filter frame supporting a filter body, and wherein the filter connector is formed by the filter frame which engages a filter mounting on the frame to thereby attach the filter member to the frame.

13. Apparatus according to claim 12, wherein the filter member includes first and second filter member contacts mounted on the filter frame and wherein the first and second filter member contacts engage frame contacts attached to the filter mounting, and wherein the frame contacts are electrically connected to electrical equipment to thereby electrically connect the electrical component to the electrical equipment.

14. Apparatus according to claim 11, wherein the electrical component is configured to conduct power for at least one of:

a) an air filtration system; and, b) a door actuator.

15. Apparatus according to claim 11, wherein the body at least one of:

a) includes adhesive extending at least part way round the filter member to thereby attach the body to an air filtration system; and, b) is adapted to sealingly engage an air filtration system.

16. Apparatus according to claim 1, the body further including a filter member that filters air flowing into or out of the internal volume, wherein the filter member includes a filter connector that is adapted to engage the frame and a filter electrical component electrically connected to the filter connector to allow electrical signals to be transferred to or from the filter electrical component via the filter connector.

17. Apparatus according to claim 16, wherein the filter member includes a filter frame supporting a filter body, and wherein the filter connector is formed by at least part of the filter frame which engages a filter mounting on the frame to thereby attach the filter member to the frame.

18. Apparatus according to claim 17, wherein the filter member includes first and second filter member contacts mounted on the filter frame and wherein the first and second filter member contacts engage frame contacts attached to the filter mounting, and wherein the frame contacts are electrically connected to electrical equipment to thereby electrically connect the electrical component to the electrical equipment.

19. Apparatus for use in providing isolation, the apparatus being adapted to be located on a supporting surface and including an isolation tent including a frame and a body, the body having:

a) a roof member;

b) at least one wall extending between the supporting surface and the roof member in use to thereby at least partially define an internal volume substantially isolated from a surrounding environment; and, c) machine readable verification data stored in a memory attached to the isolation tent, wherein the verification data is read by a processing device when the body is connected to the frame, allowing the processing device to verify the body by confirming at least one of:

i) the body is a correct body for use with a current frame;

ii) the body has not exceeded an expiry date;

iii) the body has not exceeded a shelf life;

iv) the body has not exceeded a defined duration of use; and, v) the body has not been previously used.

20. Apparatus according to claim 16, wherein the machine readable verification data is at least one of:

a) presented as visual markings provided on the isolation tent; and, b) stored in the memory and read via at least one of:

i) wired connections via a connector;

ii) wired connections via a coupling between a filter unit and either the isolation tent or a filter member; and, iii) wireless connections.

* * * * *